US005679914A

United States Patent [19]

Niitsuma

[11] Patent Number: 5,679,914

[45] Date of Patent: Oct. 21, 1997

[54] KEYBOARD DEVICE FOR AN ELECTRONIC INSTRUMENT AND AN ELECTRONIC PIANO

[75] Inventor: Shinji Niitsuma, Hamamatsu, Japan

[73] Assignee: Kabushiki Kaisha Kawai Gakki Seisakusho, Shizuoka-ken, Japan

[21] Appl. No.: 735,122

[22] Filed: Oct. 22, 1996

[30] Foreign Application Priority Data

Oct. 25, 1995 [JP] Japan ..... 7-277909
Oct. 25, 1995 [JP] Japan ..... 7-277910
Oct. 25, 1995 [JP] Japan ..... 7-277911

[51] Int. Cl.[6] ..... G10C 3/12; G10C 3/18; G10H 1/34

[52] U.S. Cl. ..... 84/687; 84/719; 84/21; 84/236; 84/240

[58] Field of Search ..... 84/615, 626, 644, 84/658, 670, 687–690, 719, 744, 3, 20–22, 115, 236–255, 423 R

[56] References Cited

FOREIGN PATENT DOCUMENTS 4347895 3/1992 Japan .

*Primary Examiner*—Stanley J. Witkowski
*Attorney, Agent, or Firm*—Davis and Bujold

[57] ABSTRACT

A keyboard for an electronic instrument and an electronic piano providing a key touch and a key touch response similar to those of an acoustic piano and stabilizing the key touch response for each key. Two detection positions of a key stroke are detected by a jack tail sensor or a jack sensor by detecting contact of a jack tail equivalent member or a jack equivalent member, before or after a hammer equivalent member disengages from or releases from a jack equivalent member. A time difference between the two positions is not adversely affected by the let-off of the jack equivalent member. Therefore, the positions and the time difference are detected stably for each key. Sound timing and sound intensity are controlled based upon the detected positions and time difference between the positions. Therefore, a key touch response, similar to that of an acoustic piano, can be stably obtained for each key.

20 Claims, 19 Drawing Sheets

45
45a
42
44a
36
44
40
32b
34
38
28b
26a
28
32a
31
30a
31a
31c
31b
10
4
24
22
30
28a
26
20
18
6
50
8

445
445a
442
444a
436
444
440
432b
434
438
426a
428b
432a
431
428
430a
431a
410
409
424
430
428a
404
422
426
420
418
406
450
408

KEYBOARD DEVICE FOR AN ELECTRONIC INSTRUMENT AND AN ELECTRONIC PIANO

FIELD OF THE INVENTION

This invention relates to a keyboard for an electronic instrument and an electronic piano in which an action simulating load is applied to a keyboard.

BACKGROUND OF THE INVENTION

Conventionally, an electronic piano emits electronic sound from a loudspeaker in response to a player depressing or releasing keys. Such electronic sound has been improved, and has recently reached a satisfactory level. However, the key touch of an electronic piano remains significantly different from that of an acoustic piano, despite various improvements.

Specifically, an electronic piano provided with an action load simulation mechanism has been developed for providing a key touch similar to that of the acoustic piano. For example, Japanese Patent laid-open serial No. 4-347895 discloses the electronic piano, as shown in FIG. 18, incorporating a hammer arm P14 rotatable about a shaft P10 for depressing the rear end of a key P12, and, as shown in FIG. 19, incorporating a hammer arm P20 rotatable about a shaft P16 for pushing up the tip of a key P18. The action load simulation mechanism shown in FIGS. 18 and 19 has been developed to provide a key touch similar to that of an acoustic piano, while lowering the height of the frame roof of the electronic piano.

In an acoustic piano, a wippen, a jack and a hammer butt are rotated on different rotary axes, and the jack leaves the hammer butt at a different time corresponding to key depression conditions, thereby providing a complicated key touch.

In the keyboard provided with the action load simulation mechanism shown in FIGS. 18 and 19, the hammer arm is rotated about a single axis, providing a monotonous or simple key touch, unlike that of an acoustic upright piano.

To solve this problem, the applicant proposed in Japanese patent application serial No. 7-136740 (not yet laid open) an electronic piano provided with an action load simulation mechanism composed of a wippen equivalent member, a jack equivalent member and a hammer equivalent member which cooperate to produce a key touch similar to that of an acoustic piano.

However, a touch response, i.e. sounding timing, sound intensity or volume and sound stop timing corresponding to key depression and key release, remains significantly different from that of an acoustic piano.

The applicant then tried to improve touch response by obtaining data from the movement of the action load simulation mechanism. This data was detected via a plurality of sensors. However, the stability of the detection data depends on the attachment positions of these sensors.

In particular, when sound volume is determined from a time difference between the detection timing of the two sensors, a large variance is created in sound volume among the keys. As a result, the key touch response similar to that of an acoustic piano cannot be accurately obtained. Further, a deviation of the attachment position of the sensors causes a noticeable variance in the touch response of a key when the same key is repeatedly depressed.

As a result of various attempts to locate causes for the aforementioned problem, it was found that a substantial peak resistance is applied to the key when the jack equivalent member disengages or releases from the hammer equivalent member, or an associated member thereof, have an influence on the stability of the detection of the movement of the action load simulation member. It was also found that the stability of detection and the precision of sound control, while the same key is repeatedly depressed, depend the timing in the region where no influence of a substantially peak let-off resistance is experienced, and the present invention was completed.

SUMMARY OF THE INVENTION

An object of the present invention is to provide a keyboard for an electronic instrument, and an electronic piano incorporating the keyboard, that provide a key touch and a key touch response similar to those of an acoustic piano and stably detect the timing and force corresponding to a string striking timing and force.

Another object of the present invention is to provide a keyboard for an electronic instrument, and an electronic piano incorporating the keyboard, that provide a key touch and a key touch response similar to those of an acoustic piano and assure the continuation of sound when the same key is repeatedly depressed.

A further object of the present invention is to provide a keyboard for an electronic instrument, and an electronic piano incorporating the keyboard, that provide a key touch and a key touch response similar to those of an acoustic piano and correctly control the sounding.

To attain this or other objects, the present invention provides a keyboard for an electronic instrument for applying an action simulating load to a keyboard. In the keyboard, an action load simulation mechanism is provided with a wippen equivalent member, a jack equivalent member, a hammer equivalent member and a stop. The wippen equivalent member is rotatably mounted for rotating together with a key during key depression, and the jack equivalent member is rotatably mounted to the wippen equivalent member for rising as the wippen equivalent member is rotated during key depression. The hammer equivalent member is pushed up and rotated by the jack equivalent member while the jack equivalent member is raised to a predetermined position, and disengages from the jack equivalent member and inertially rotates after the jack equivalent member is raised to the predetermined position. The stop contacts a tip of the hammer equivalent member for stopping the inertial movement of the hammer equivalent member. The keyboard provides a key touch similar to that of an acoustic piano.

When the key is depressed, a force is exerted by the key to a finger, i.e. a static load of the key is increased while the key is depressed to a certain amount. Subsequently, the static load becomes almost constant regardless of the depth of depression. When the depth is close to a maximum stroke position, the static load abruptly increases. A substantially peak static load or resistance is generated corresponding to the hammer equivalent member being disengaged from the jack equivalent member, between the key depression start position and the maximum stroke position.

The applicant of the present invention invented a keyboard, for an electronic instrument, which can attain the aforementioned objects by detecting movement of the action load simulation mechanism outside the range of the substantially peak resistance.

A first aspect of the present invention provides a keyboard with a first sensor and a second sensor. The first sensor detects a first time at which a member of the action load simulation mechanism reaches a first predetermined position, before the substantially peak resistance is applied by the hammer equivalent member disengaging from the jack equivalent member. The second sensor detects a second time at which a member of the action load simulation mechanism reaches a second predetermined position, before the substantially peak resistance is applied by the hammer equivalent member disengaging from the jack equivalent member, after the first sensor detects the first time.

As aforementioned, both the first sensor and the second sensor detect the respective timings before the substantially peak resistance is applied to the key when the hammer equivalent member disengages from or lets off (releases from) the jack equivalent member, that is, before a let-off resistance reaches its peak.

Even if the key is depressed with the same force in the region having the let-off resistance, only a slight deviation of the detection position of the first and second sensors produces a difference in the detection timing, because the resistance provided to the key from the hammer equivalent member largely varies. Especially while the static load of the key is in a let-off resistance peak, a difference in the resistance force because of the detection position is larger, as compared with before and after the let-off resistance reaches its peak. Therefore, if the detection position of either one of the sensors is within the let-off resistance peak, a sound volume and a sound timing vary with keys.

The resistance varies only little at any key depression depth before the let-off resistance peak. When no damper mechanism is incorporated in the action load simulation mechanism, the resistance varies very little before the let-off resistance peak.

Both the first and second sensors detect the contact time of either member of the action load simulation member at a predetermined key stroke position before the let-off resistance peak. A time difference between the detection times of the sensors varies little and remains stable for each key. Therefore, data precisely corresponding to a string striking timing and strength can be obtained.

In an electronic piano or other electronic instrument, sound timing and sound volume can be controlled precisely and stably for each key. A stable key touch response is obtained. A key touch and a key touch response similar to those of an acoustic piano can be provided.

The first or second sensor detects the contact timing of the key, the wippen equivalent member, the jack equivalent member or an associated member thereof in the action load simulation mechanism.

The associated member of the jack equivalent member is, for example, a jack tail equivalent member.

The keyboard, made in accordance with the present invention, is also provided with a third sensor for detecting a key release time. The third sensor detects the key release time from movement of the key, the wippen equivalent member, the jack equivalent member or an associated member thereof.

The second sensor can serve as the third sensor to reduce component costs.

When the aforementioned keyboard is incorporated in an electronic upright piano, in an electronic sounding control mechanism, the sound timing is controlled based on the first time detected by the first sensor, the sound intensity or volume is controlled based on a time difference between the first time detected by the first sensor and the second time detected by the second sensor, and the sound stop time is controlled based on the key release timing detected by the third sensor. The electronic piano can be played stably with a key touch and a key touch response similar to those of an acoustic piano.

A second aspect of the present invention provides the keyboard with a first sensor and a second sensor. The first sensor detects a first time at which a member of the action load simulation mechanism reaches a first predetermined position, after a substantially peak resistance is applied by the hammer equivalent member disengaging from the jack equivalent member. The second sensor detects a second time at which a member of the action load simulation mechanism reaches a second predetermined position, after the substantially peak resistance is applied by the hammer equivalent member disengaging from the jack equivalent member, and after the first sensor detects the first time.

As aforementioned, both the first sensor and the second sensor detect the respective timings after the substantially peak resistance is applied to the key when the hammer equivalent member disengages from or lets off the jack equivalent member, that is, after a let-off resistance reaches its peak.

When the detection positions of the sensors are disposed after the position of the let-off resistance peak, the resistance varies less, as compared with when the detected position of either sensor is within the let-off resistance peak.

Both the first and second sensors detect the contact time of either member of the action load simulation member at a predetermined key stroke position after the let-off resistance peak. A time difference between the detected times of the sensors varies little and remains stable for each key. Therefore, data precisely corresponding to string strike timing and strength can be obtained.

The let-off resistance peak is not located in a region deeper along the key stroke than the detection positions of the first and second sensors. The detection position of the first and second sensors can be set sufficiently close to a maximum stroke position. Specifically, the first and second sensors can be located to detect at a sufficiently deep position of key stroke. Even when the key is repeatedly depressed or released at a small stroke deep in the key stroke, for example, even when the same key is repeatedly depressed, the sound timing and sound strength can be accordingly detected and controlled.

For example, the action load simulation mechanism can be designed such that the let-off position is located at a shallow key stroke position, a large region deep in the key stroke with only a little change in a static load is provided, and a sufficient difference between the detection positions of the first and second sensors can be provided. In this structure, a change of the key position in the key stroke can be precisely detected, and stable sound strength data can be obtained.

A third aspect of the present invention provides the keyboard with a first sensor and a second sensor. The first sensor detects a first time at which a member of the action load simulation mechanism reaches a first predetermined position, before a substantially peak resistance is applied by the hammer equivalent member disengaging from the jack equivalent member. The second sensor detects a second timing at which a member of the action load simulation mechanism reaches a second predetermined position, after the substantially peak resistance is applied by the hammer equivalent member disengaging from the jack equivalent member.

As aforementioned, the first sensor detects the first time before the substantially peak resistance is applied to the key when the hammer equivalent member disengages from or lets off the jack equivalent member, that is, before a let-off resistance reaches its peak. The detection position of the first sensor is not at the position of the let-off resistance peak.

The first sensor detects the time before the substantially peak resistance is applied to the key when the hammer equivalent member disengages from or lets off the jack equivalent member, that is, before a let-off resistance reaches its peak. The detection position of the first sensor is not within the position of the let-off resistance peak. Further, the let-off resistance peak is interposed between the detection positions of the first and second sensors.

There is only little difference in the resistance applied to the key from the hammer equivalent member between the regions before and after the position of the let-off resistance peak. Therefore, even when the detection positions of the first and second sensors are separated before and after the position of the let-off resistance peak, the detection data for each key varies less as compared with when either position of the sensors is included within the position of the let-off resistance peak.

At the separate detection positions, the first and second sensors detect the contact time of either member of the action load simulation mechanism. A time difference in the detection time of the sensors between the keys varies only little and becomes stable. Therefore, the precise data corresponding to a string strike timing and strength can be obtained.

Further, there is no let-off resistance peak on the deeper side in key stroke than the detection position of the second sensor. The detection position of the second sensor can be sufficiently close to the maximum key stroke position. In an acoustic piano, a string striking position is further than a key stroke limit. Therefore, a time interval between the detection time of the second sensor and a string striking equivalent timing is shorter as compared with when the detection position of the second sensor is disposed before the let-off resistance peak. The variance due to disturbance during the time interval can be little, and sound timing with only little error can be obtained from the detected timing of the second sensor.

Even when the key is repeatedly depressed and released at a small stroke deep in the key stroke, for example, even when the same key is continuously depressed, the detection position of the first sensor can be set close to the let-off resistance peak. Because the detection position of the second sensor is further along the key stroke than the position of the let-off resistance peak. Since the let-off resistance peak is interposed between the detection position of the first sensor and that of the second sensor, a sufficient difference between the detection positions can be obtained therebetween for measuring a correct time difference between the detected times of the sensors. Furthermore, the detection position of the first sensor is spaced apart from that of the second sensor, and the detection position of the second sensor can be close to the detection position of the let-off resistance peak. The second sensor can have a detection position at a deeper key stroke position. The sound timing and strength can be detected at a rather deep key stroke position, and continuous sound or continuous depressing of the same key is assured.

For example, the action load simulation mechanism can be designed such that a region with only little change in a static load, or a flat region is provided at a shallow and at a deep key stroke. By setting the detection position of the first sensor on a side of a flat region having a shallow key stroke and setting the detection position of the second sensor on a side of a flat region having a deep key stroke, a change in the key position in the key stroke between the first and second sensors can be correctly obtained for each key. Therefore, the data of the sound timing and sound strength or volume can be stably obtained.

DESCRIPTION OF THE DRAWINGS

The invention will now be described, by way of example, with reference to the drawings, in which.

DETAILED DESCRIPTION OF THE PREFERRED EMBODIMENTS

First Embodiment

Figure 1:
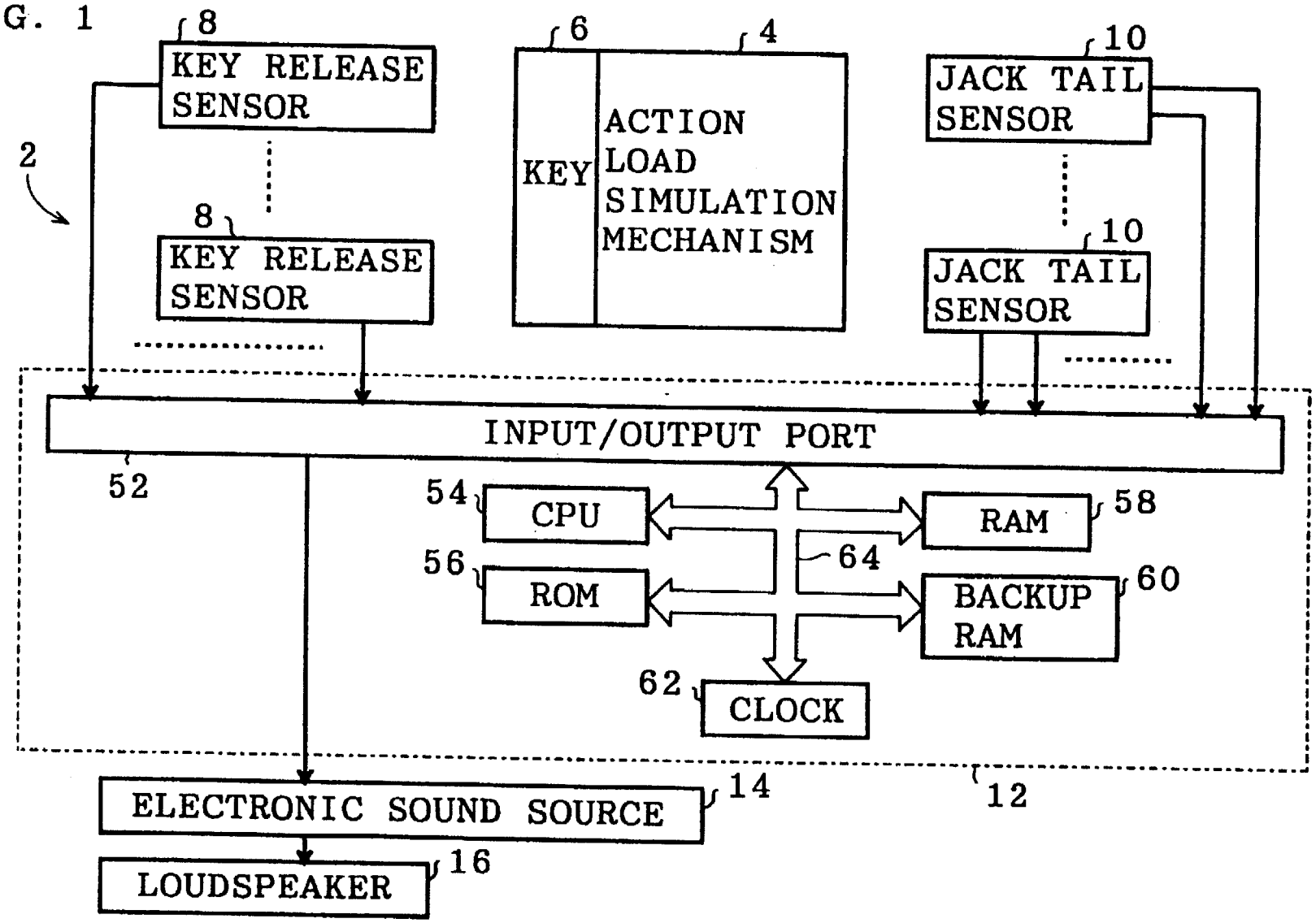
FIG. 1 is a block diagram showing an electronic upright piano according to a first embodiment of the present invention.

As shown in FIG. 1, an electronic piano 2 of the first embodiment is composed of an action load simulation mechanism 4, keys 6, a key release sensor 8 and a jack tail sensor 10 associated with each key 6, a controller 12, an electronic sound source 14 and a loudspeaker 16. The action load simulation mechanism 4, the keys 6, the key release sensors 8 and the jack tail sensors 10 all form a keyboard device.

Figure 2:
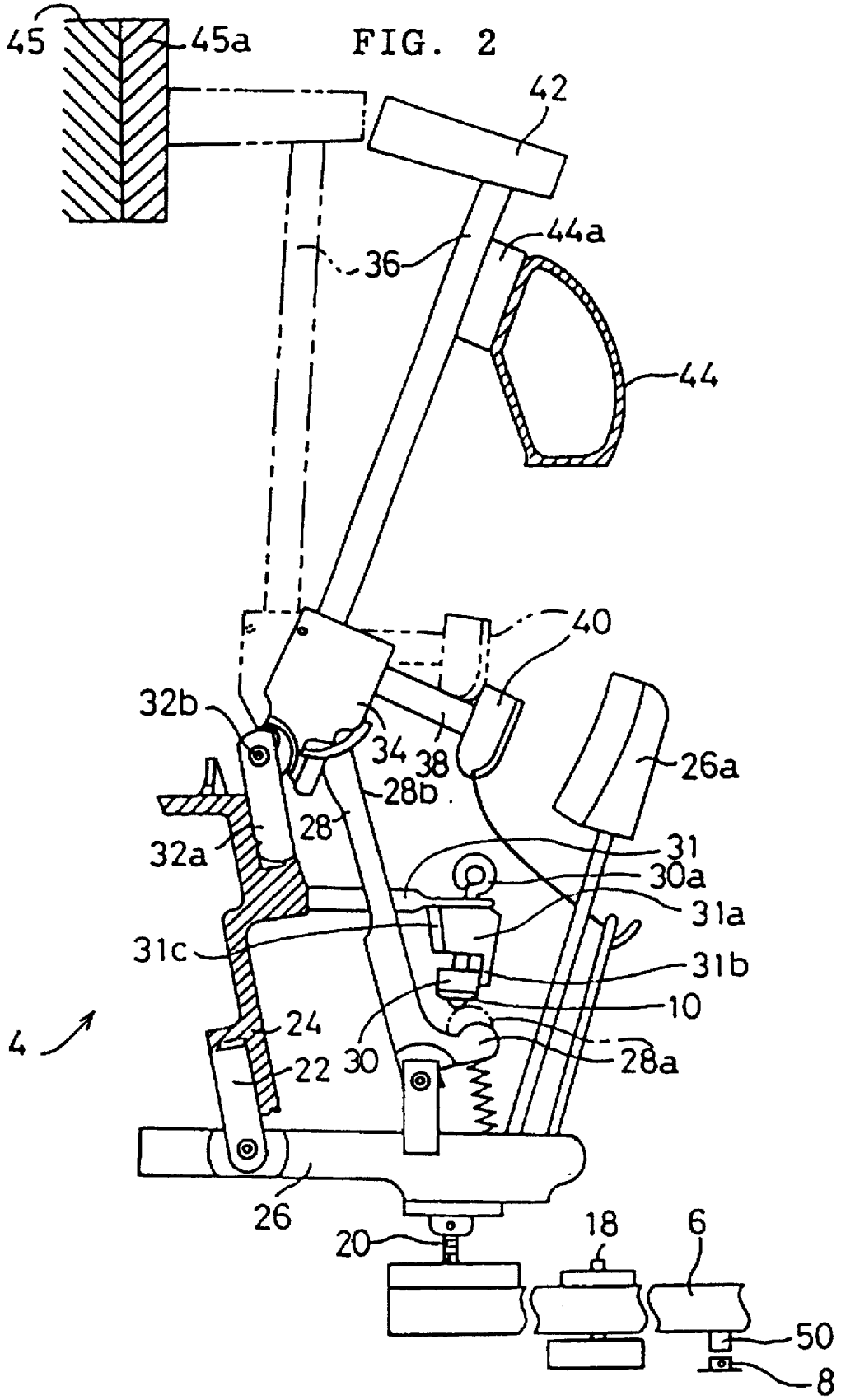
FIG. 2 is a partial sectional view of the first embodiment of an action load simulation mechanism made in accordance with the present invention.

The action load simulation member 4, as shown in FIG. 2, is composed of a capstan equivalent member 20, a wippen equivalent member 26 rotatably connected via a wippen flange equivalent member 22 with a center rail equivalent member 24, and a jack equivalent member 28 rotatably connected to the wippen equivalent member 26. After the key 6 is depressed and rotated clockwise about a balance pin 18 as viewed in FIG. 2, the capstan equivalent member 20 is raised causing the wippen equivalent member 28 to rotate in a reverse direction relative to the rotary direction of the depressed key 6. The jack equivalent member 28 rises together with the wippen equivalent member 28, until a jack tail equivalent member 28*a* contacts a bottom of a regulating button equivalent member 30. The action load simulation member 4 is also composed of a butt equivalent member 34 rotatably supported by a center pin equivalent member 32*b* of a butt flange equivalent member 32*a* fixed to the center rail equivalent member 24. The butt equivalent member 34 is releasably engaged with the hammer jack equivalent member 28. The action load simulation member 4 is further composed of a hammer shank equivalent member 36 connected to the butt equivalent member 34, and a catcher shank equivalent member 38 projecting from the butt equivalent member 34 perpendicular to the hammer shank equivalent member 36. The butt equivalent member 34 is thrust upward by the jack equivalent member 28 causing the hammer shank equivalent member 36 to rotate in a reverse direction relative to the rotary direction of the depressed key 6. A catcher equivalent member 40 is attached to a tip of the catcher shank equivalent member 38, a hammer equivalent member 42 is attached to a tip of the hammer shank equivalent member 36, and a hammer rail equivalent member 44 is provided with a contact portion 44*a*. When the hammer shank equivalent member 36 returns after key depression, a rear side of the hammer shank equivalent member 36 contacts the contact portion 44*a* which absorbs the vibration of the hammer equivalent member 42.

The hammer equivalent member 42 is designed to have a center of gravity with the weight of a hammer felt included therein, although it is provided with no hammer felt unlike that of an acoustic upright piano.

A lower part of the regulating button equivalent member 30 is provided with a jack tail sensor 10 opposite to the jack tail equivalent member 28*a*, such that the jack tail sensor 10 is in contact with the jack tail equivalent member 28*a* upon key depression thereby stopping the jack tail equivalent member 28*a* and absorbing any contact shock. The contact position of the jack tail sensor 10 and the jack tail equivalent member 28*a* is adjustable by rotating an adjustment screw 30*a* fixed to a regulating rail 31*a* thereby vertically moving the regulating button equivalent member 30. The regulating rail 31*a* is fixed to an end portion of a regulating bracket 31 and has a guide 31*b* which limits the rotation of the regulating button equivalent member 30 relative to the adjustment screw 30*a*. The vertical position of the regulating button equivalent member 30 can thus be vertically adjusted without rotating the regulating button equivalent member 30. The regulating rail 31*a* has a jack stopper felt equivalent member 31*c*, on the side opposed to the guide 31*b*, for contacting the jack equivalent member 28 upon key depression and preventing noise that results from such contact.

Upon key depression, the rotation of the wippen equivalent member 26 raises the jack equivalent member 28 which, in turn, thrusts the butt equivalent member 34 upward thereby causing the hammer equivalent member 42 to rotate counterclockwise, as viewed in FIG. 2. Eventually, the jack tail equivalent member 28*a* contacts the bottom of the regulating button equivalent member 30 causing the jack equivalent member 28 to rotate clockwise and disengage or let off from the butt equivalent member 34. Subsequently, the hammer equivalent member 42 inertially and continuously rotates counterclockwise, as viewed in FIG. 2, until the hammer equivalent member 42 contacts a hammer stopper felt 45*a* provided on a hammer stopper 45.

The jack tail sensor 10 serves as a jack tail stopper felt equivalent member for contacting the jack tail equivalent member 28*a* before the jack equivalent member 28 disengages from the butt equivalent member 34.

The jack tail sensor 10 is preferably a rubber hollow member and is easily deformed upon contact with the jack tail equivalent member 28*a*, such that an inner conductive contact connects inner terminals.

Figure 6A:
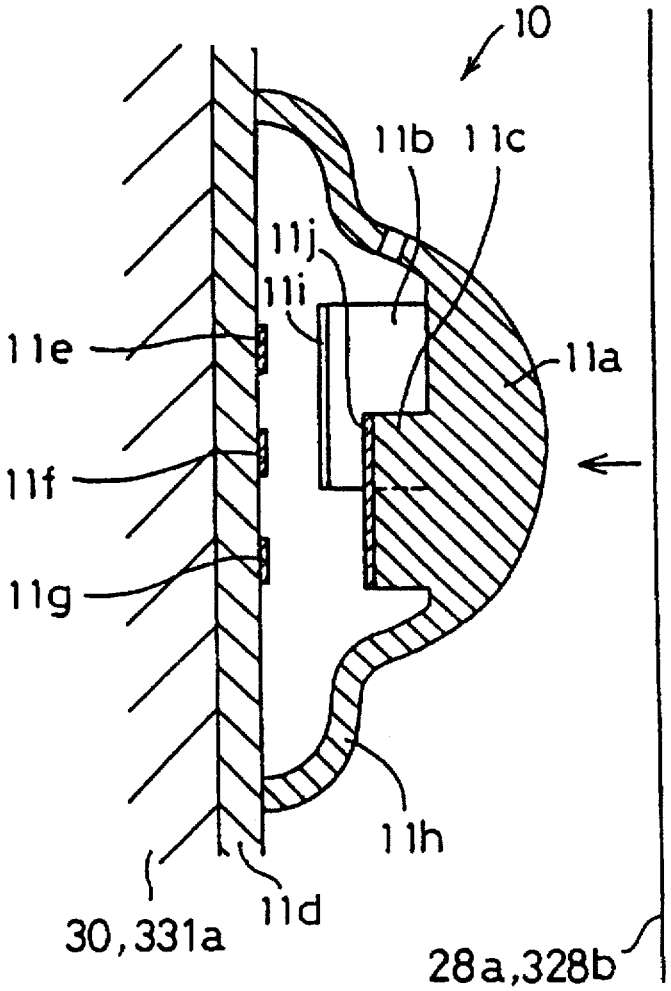
FIGS. 6A is a sectional view of a jack tail sensor made in accordance with the present invention.

As shown in FIG. 6A, in the jack tail sensor 10, two planar projections 11*b* and 11*c*, having different lengths, project inwards from a rubber head 11*a*, and three terminals 11*e*, 11*f* and 11*g* are provided on a bottom plate 11*d*.

When a key 6 is depressed, causing the jack tail equivalent member 28*a* to compress a side wall 11*h* by a predetermined amount, a first conductive contact 11*i* formed on an inwardly facing surface of the longer planar projection 11*b* completes a short circuit between the terminals 11*e* and 11*f*. Specifically, a first sensor formed by the planar projection 11*b*, the first conductive contact 11*i* and the terminals 11*e*, 11*f* is turned on. When the side wall 11*h* is compressed further, a second conductive contact 11*j* formed on an inwardly facing surface of the shorter planar projection 11*c* completes a short circuit between the terminals 11*f* and 11*g*. Specifically, a second sensor formed by the planar projection 11*c*, the second conductive contact 11*j* and the terminals 11*f*, 11*g* is turned on.

Figure 6B:
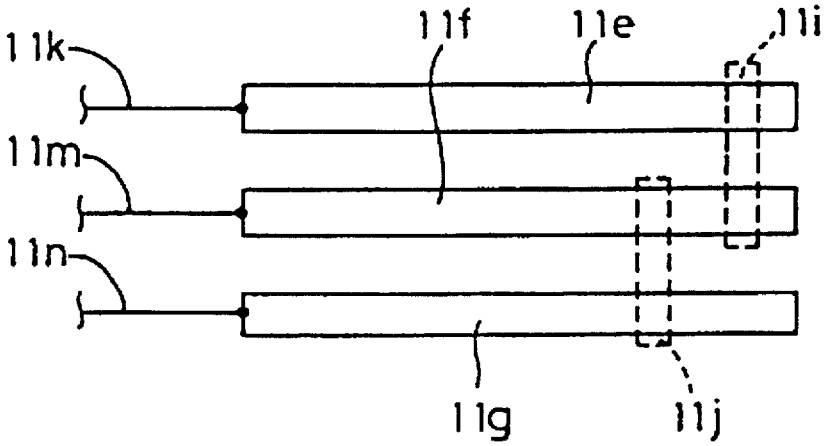
FIG. 6B is a diagrammatic view of terminals of the jack tail sensor.

Therefore, as shown in FIG. 6B, the contact timing of the jack tail equivalent member 28*a* is detected by detecting a change in impedance between signal lines 11*m* and 11*n* by the controller 12. The controller 12 can also detect the contact intensity or speed of the jack equivalent member 28 by detecting a time difference between the detected time of the impedance change between signal lines 11*k* and 11*m* and that between the signal lines 11*m* and 11*n*.

Returning now back to FIG. 2, a shutter 50, attached to the underside of the key 6, moves vertically as the key 6 is depressed and rotated about the balance pin 18. A key release sensor 8 positioned under the key 6 is provided with a photo-interrupter for optically detecting key release. When a light path formed in the photo-interrupter is interrupted by the shutter 50, an OFF signal is transmitted, otherwise an ON signal is transmitted.

When the key 6 is continuously depressed, the key release sensor 8 continuously transmits an OFF signal. Upon key release, the OFF signal is changed over to an ON signal. By detecting the signal change of the key release sensor 8, a key release timing is detected. Based on the key release timing, a sound stop time can be controlled by the controller 12.

As shown in FIG. 1, the controller 12 is an arithmetic logic circuit including an input/output port 52, a CPU 54, a ROM 56, a RAM 58, a back-up RAM 60, a clock 62 and other, which are interconnected via a bus 64. The controller 12 is connected via the input/output port 52 to the key release sensors 8 and the jack tail sensors 10, and also to the electronic sound source 14.

The CPU 54 detects the terminal connection time of the second conductive contact 11*j* in the jack tail sensor 10, a time difference in the terminal connection time between the conductive contacts 11*i* and 11*j*, and further the time at which the signal of the key release sensor 8 is changed from OFF to ON. Based on this data received by the CPU 54 and a control program stored in the ROM 56, a signal is transmitted to the electronic sound source 14. The controller 12 is also connected to a pedal sensor (not shown) for detecting the operation of a damper pedal, soft pedal or other pedal mechanism. The CPU 54 also receives pedal information to control the signal sent to the electronic sound source 14.

Figure 3:
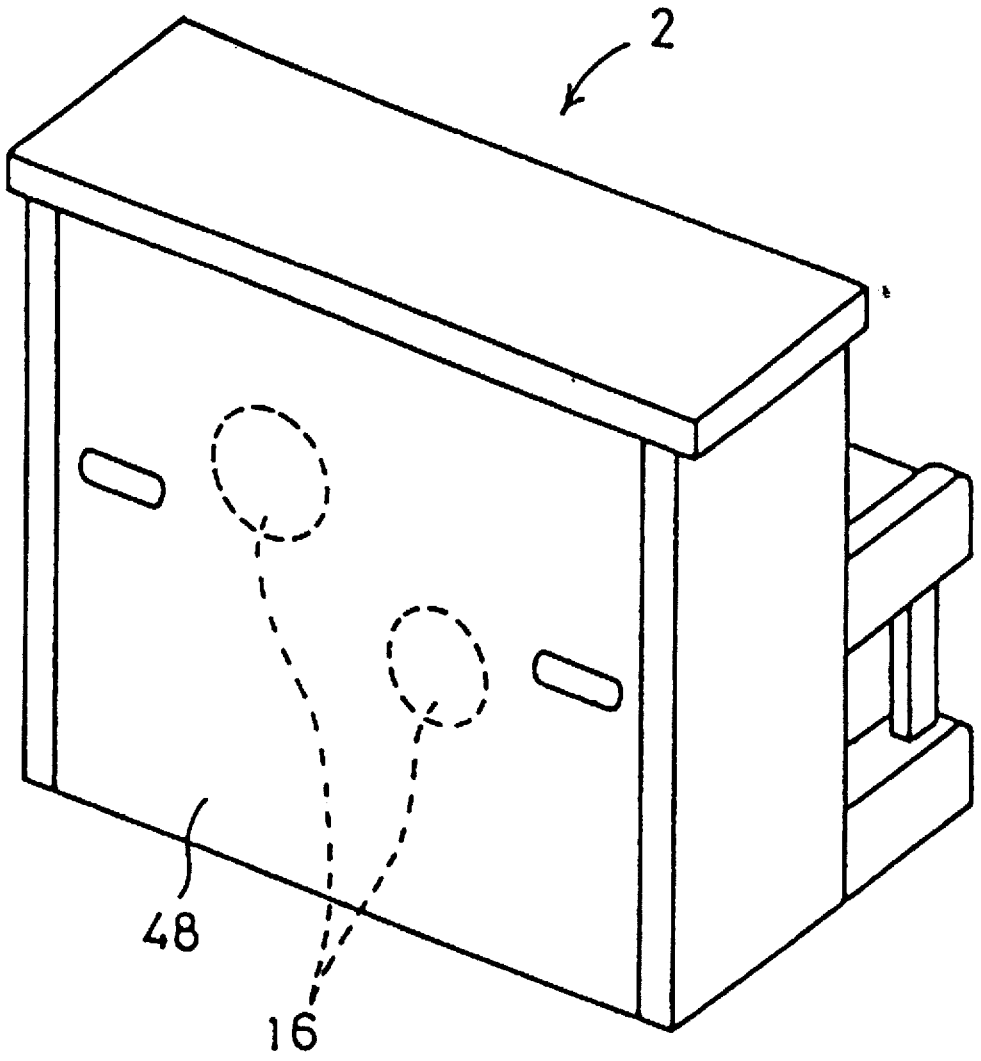
FIG. 3 is a perspective view of the electronic upright piano made in accordance with the present invention.
Figure 4:
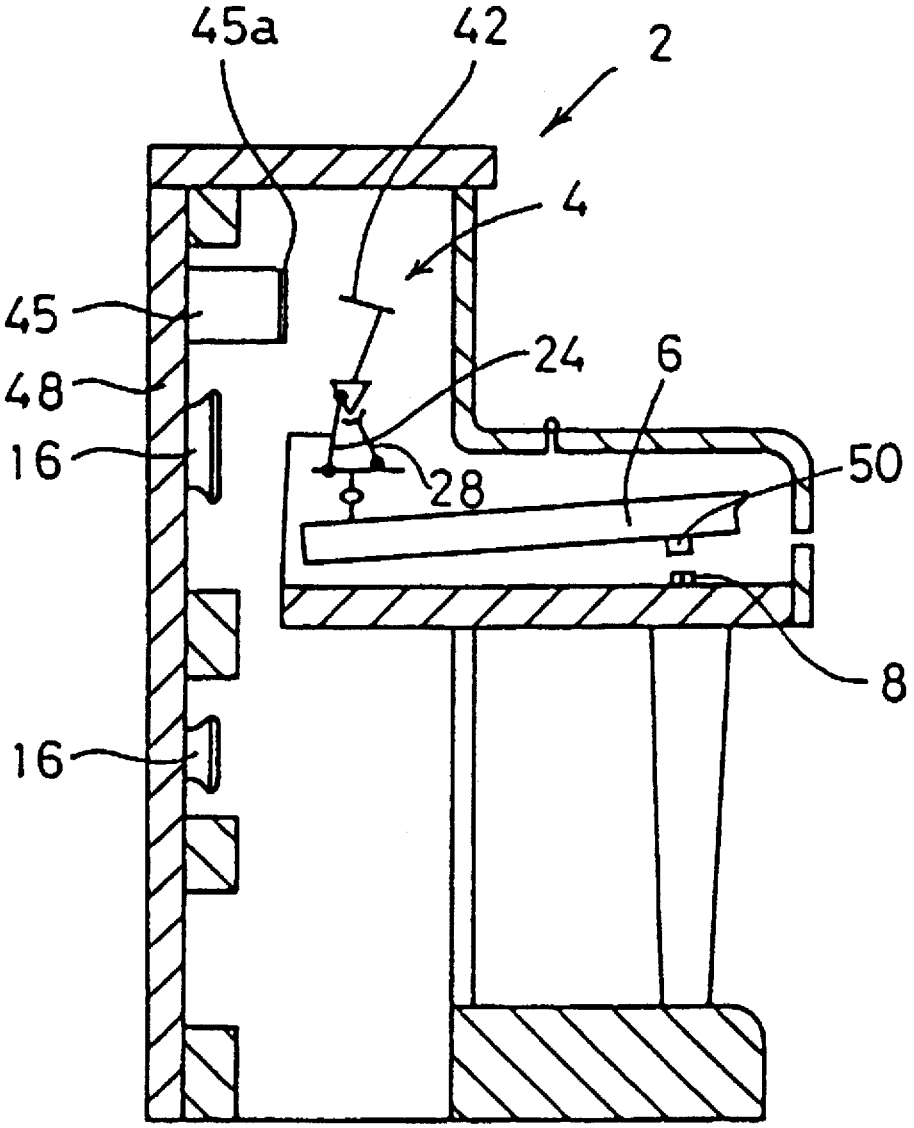
FIG. 4 is a sectional view of the electronic upright piano shown in FIG. 3.

The electronic sound source 14 is composed of a record unit for storing an acoustic piano sound or a string striking sound and a reproduction unit for reading the sound from the record unit, and is attached to the inner bottom face of the electronic upright piano 2 for emitting sound via the loudspeakers 16. As shown in FIGS. 3 and 4, the loudspeakers 16 are attached on a rear plate 48, facing forward or toward a player.

The operation of the electronic upright piano 2, having the aforementioned structure, is now explained with reference to FIG. 2. When a player depresses the key 6, the key 6 rotates clockwise, as viewed in this figure, about the balance pin 18, and the wippen equivalent member 26 rotates in the reverse direction relative to the rotary direction of the key 6, or counterclockwise as viewed in this figure. Accordingly, the jack equivalent member 28 moves upward and influences the butt equivalent member 34. The butt equivalent member 34 rotates together with the hammer shank equivalent member 36 and the hammer equivalent member 42 rotates in the reverse direction relative to the rotary direction of key 6, or counterclockwise as viewed in this figure. After the jack equivalent member 28 rises to a predetermined position, the jack tail equivalent member 28*a* contacts the jack tail sensor 10 on the underside of the regulating button equivalent member 30 thereby now causing the jack equivalent member 28 to rotate clockwise, as viewed in this figure, and disengage from or let off the butt equivalent member 34. The butt equivalent member 34, the hammer shank equivalent member 36 and the hammer equivalent member 42, disengaged from the jack equivalent member 28, still continue to inertially rotate. A side surface 28*b* of the jack equivalent member 28 contacts the jack stopper felt equivalent member 31*c*, and the hammer equivalent member 42 contacts the hammer stopper 45, thereby limiting the inertial rotation of the hammer equivalent member 42.

Figure 5:
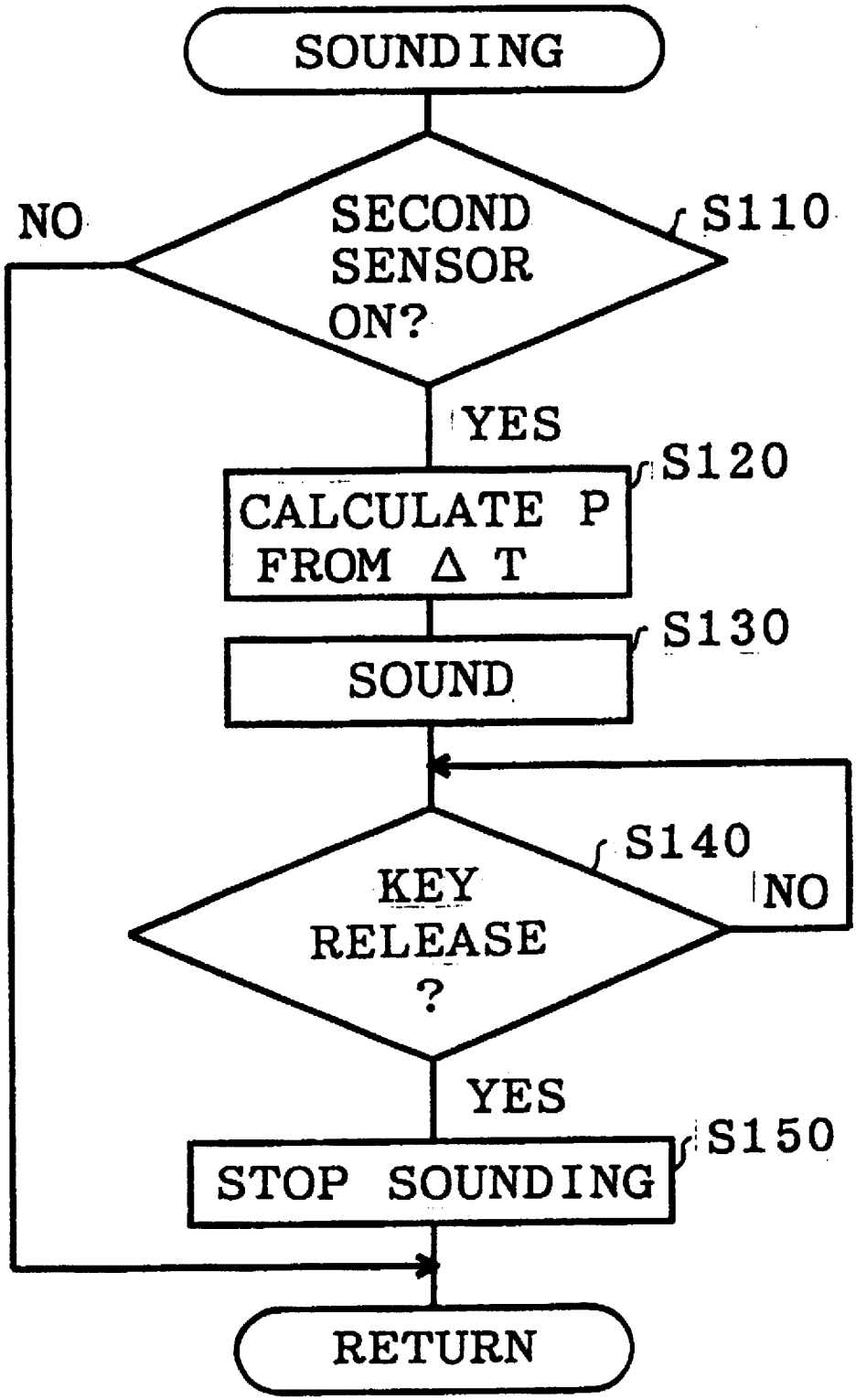
FIG. 5 is a flowchart of the sound process.

The sound process of the control unit 12 is now explained referring to the flowchart of FIG. 5.

The sounding process is an interruption process started when a short circuit is completed between the terminals 11*e* and 11*f* by the first conductive contact 11*i* in the jack tail sensor 10, i.e. the first sensor is turned on. When the sounding process starts, it is determined at step S110 whether or not the second sensor turns on within a predetermined time after the first sensor turns on. Specifically, it is determined whether or not the signal lines 11*m* and 11*n* are electrically connected via the second conductive contact 11*j* within a predetermined time after the jack tail equivalent member 28*a* of the jack equivalent member 28 contacts the jack tail sensor 10, electrically connecting the signal lines 11*k* and 11*m* via the first conductive contact 11*i*. When the second sensor transmits an ON signal to the controller 12 within the predetermined time after the first sensor transmits an ON signal to the controller 12, it is determined that the contact between the jack tail equivalent member 28*a* and the jack tail sensor 10 is detected, corresponding to a string striking timing in an acoustic piano. The predetermined time is set longer than a typical time interval for the electrical connection between the signal lines 11*k* and 11*m* to the electrical connection between the signal lines 11*m* and 11*n*.

The sound process ends when the answer to step S110 is negative, when the second sensor does not transmit an ON signal, or when an electrical connection between the signal lines 11*m* and 11*n* via the second conductive contact 11*j* of the jack tail sensor 10 is not detected within the predetermined time. The sound process will begin again, once a short circuit is completed between the terminals 11*e* and 11*f* by the first conductive contact 11*i* in the jack tail sensor 10, i.e. the first sensor again transmits an ON signal.

If the answer to step S110 is affirmative, then the operation of the jack tail equivalent member 28*a* is effective and the process advances to step S120. First, the controller 12 measures a time difference ΔT between the transmission of an ON signal from the first sensor representing the electrical connection between the signal lines 11*k* and 11*m* via the first conductive contact 11*i* and the transmission of an ON signal from the second sensor representing the electrical connection between the signal lines 11*m* and 11*n* via the second conductive contact 11*j*. The ON signals are received via the input/output port 52 or the RAM 58 and a contact strength P corresponding to a string striking strength is obtained from the time difference ΔT, for example, from the following formula:

$P=K/\Delta T$, in which K is a constant.

A waveform signal is obtained by determining the frequency and amplitude based on the height of the tone of the depressed key and the contact strength P. By controlling an electronic sound source 14 based on the predetermined waveform signal, sound is emitted from the loudspeakers 16 at step S130.

Subsequently, it is determined at step S140 whether or not key release is detected by the key release sensor 8. A key release is detected when the signal transmitted from the key release sensor 8 is changed from OFF to ON. When a key release is detected, step S150 terminates the sound from the electronic sound source 14, thereby ending the process. Every time the first conductive contact 11*i* completes the short circuit between the terminals 11*e* and 11*f*, the process shown in the flowchart of FIG. 5 is repeated. When a plurality of keys are depressed at the same time, a process for each depressed key is completed. The processes for simultaneously depressed keys are all executed parallel with one another.

The first embodiment of the electronic upright piano 2 has the following advantage.

(1) The butt equivalent member 34 is connected via the hammer shank equivalent member 36 to the hammer equivalent member 42. The jack equivalent member 28 imparts a motive energy to the hammer equivalent member 42. The hammer equivalent member 42 contacts the hammer stopper 45 with the motive energy which corresponds to a hammer striking a string of an acoustic piano. Therefore, the contact timing and strength of the jack tail equivalent member 28*a* of the jack equivalent member 28, imparting the motive energy to the hammer equivalent member 42, corresponds to the string striking timing and strength of the acoustic piano.

An adequate sound timing and sound intensity or volume are calculated by the controller 12, based upon the contact time and strength of the jack tail equivalent member 28*a* detected by the jack tail sensor 10. Therefore, upon key depression, a key touch response similar to that of an acoustic piano can be obtained.

Figure 7:
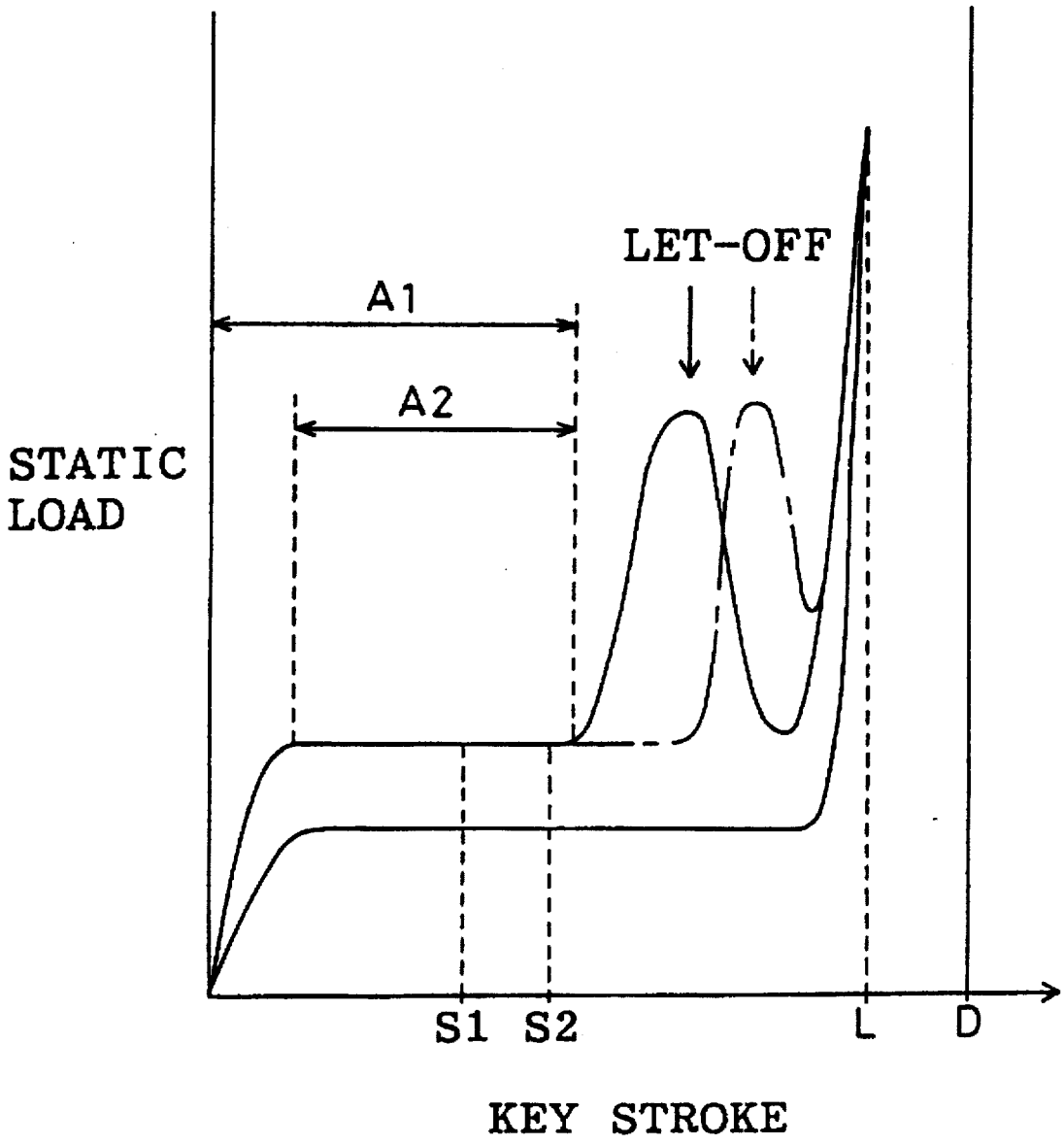
FIG. 7 is a graph showing the relationship of sensor detection positions of a key stroke and a static load of the first embodiment.

As shown in FIG. 7, the first and second sensors of the jack tail sensor 10 detect the jack tail equivalent member 28*a* contacting the underside of the regulating button equivalent member 30 before a substantial peak let-off resistance arises when the butt equivalent member 34 disengages from or lets off the jack equivalent member 28. As shown in FIG. 6A, the first sensor formed of the planar projection 11*b* is longer than the second sensor of the planar projection 11*c*. Also in the key stroke, as shown in FIG. 7, the first sensor turns on at a key stroke position S1. Subsequently, the second sensor turns on at a key stroke position S2, before the let-off resistance reaches a peak.

As aforementioned, the detection of both the first and second sensors precedes the substantial peak let-off resistance. Specifically, the detection position of the first or second sensor is not within the let-off resistance peak.

Therefore, a time difference between the detection time of the first sensor and that of the second sensor can be stably and precisely obtained for each key, correctly reflecting a player's key depression speed. The data corresponding to the string striking strength of an acoustic piano can be stably and precisely obtained for each key 6 in the electronic upright piano 2.

Because the key touch response is stabilized, the sound intensity or volume can be stably and precisely controlled, while correctly reflecting the player's key operation.

The timing of the hammer equivalent member 42 contacts the hammer stopper 45 which corresponds to the string striking timing of an acoustic piano. As shown in FIG. 7, the contact timing occurs at a key stroke position D which occurs after a key stroke limit L. However, the contact timing of the hammer equivalent member 42, at the key stroke position D, can be accurately estimated based on the distance between the detection positions S1, S2 and D and a time interval between the detected positions S1 and S2. Therefore, the string striking equivalent timing can also be stably and precisely detected for each key. The sounding timing can also be stably and precisely controlled. Also, the key touch response is stabilized.

The advantage can be expected when the positions S1 and S2, as shown in FIG. 7, occur in a key stroke region A1 which is prior to the let-off resistance peak. Preferably the positions S1 and S2 occur in a flat key stroke region A2 in which only a slight variance in the load arises.

Furthermore, the release timing of the key 6 is detected by the key release sensor 8. The controller 12 can accurately obtain the sound stop time.

As aforementioned, the contact timing and strength of the jack tail equivalent member 28*a* are detected by the jack tail sensor 10, while the key release timing is detected by the key release sensor 8. In the electronic upright piano 2, the sounding timing, the sound intensity or volume, the sound stop time, and the key touch response can emulate those of an acoustic piano.

(2) The jack tail sensor 10 is formed of a rubber switch and serves as a jack tail stopper felt equivalent member for preventing noise resulting from contact with the jack tail equivalent member 28*a*, thereby obviating the necessity of a separate jack tail stopper felt equivalent member.

(3) Like an acoustic upright piano, the wippen equivalent member 15, the jack equivalent member 28 and the butt equivalent member 34 are rotated about independent axes. When the butt equivalent member 34 is influenced upward by the jack equivalent member 28, the hammer equivalent member 42 rotates. Subsequently, when the jack equivalent member 28 disengages from the butt equivalent member 34, the hammer equivalent member 42 moves inertially. The inertial movement of the hammer equivalent member 42 is stopped by the hammer stopper 45. Therefore, the let-off timing of the jack equivalent member 28 from the butt equivalent member 34 and key touch are the same as those of an acoustic upright piano.

Further, as shown in FIG. 7, the detection positions S1 and S2 of the jack tail sensor 10 occur prior to the let-off position. The let-off position can be set further along the key stroke, for example, as shown by a dashed line in FIG. 7, closer to the key stroke limit L, thereby making the key touch much closer to that of an acoustic piano.

(4) The electronic upright piano also has an appearance and an action mechanism similar to those of an acoustic piano, and provides a heavy and beautiful impression in the interior, like an acoustic piano.

(5) No string is provided in the electronic upright piano, thereby obviating the necessity for frames, supports or other weight members, unlike an acoustic piano. Dampers are also unnecessary in the electronic upright piano, thereby reducing the weight and the manufacturing costs.

Second Embodiment

Figure 8:
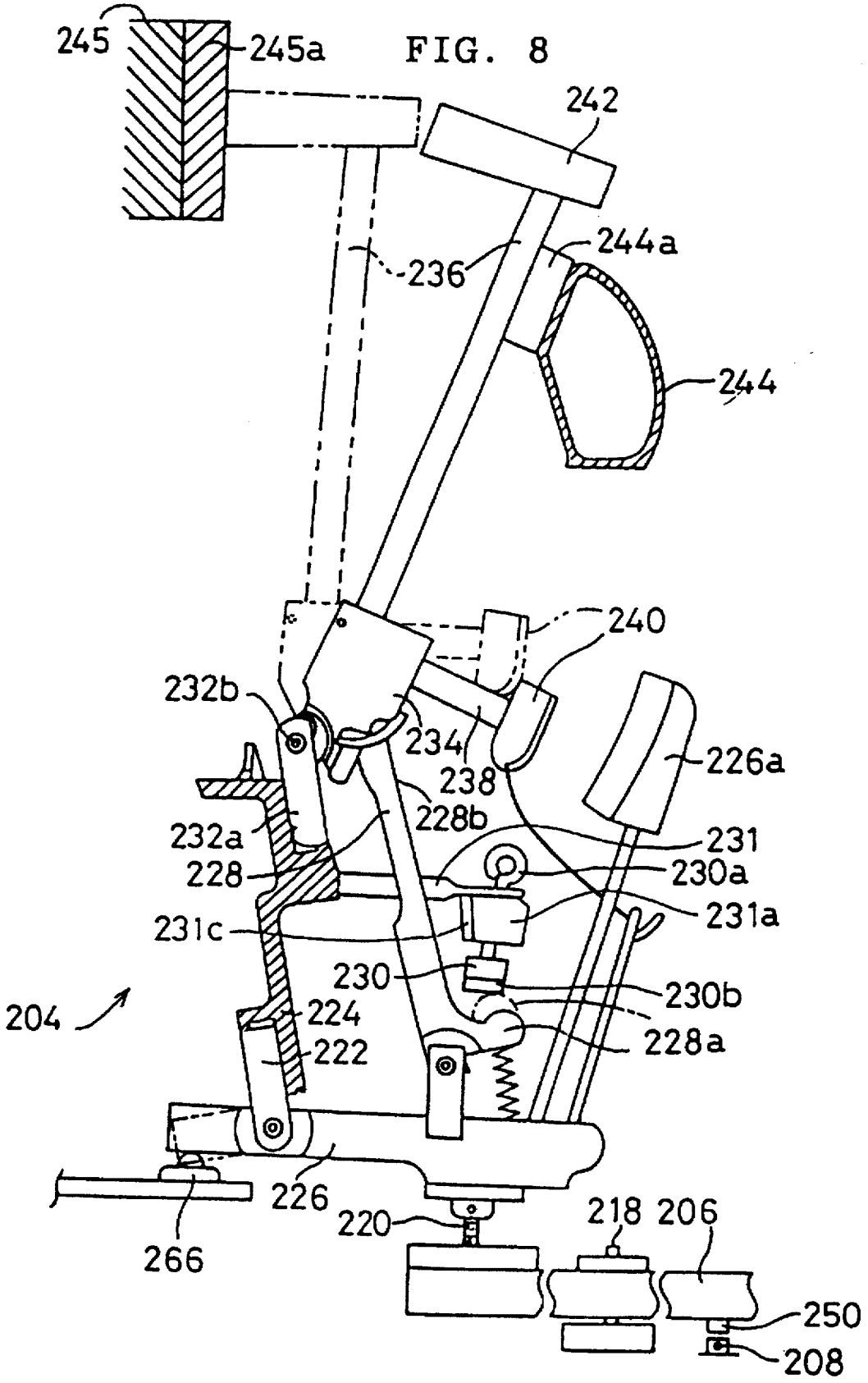
FIG. 8 is a sectional view of a second embodiment of an action load simulation mechanism made in accordance with the present invention.

As shown in FIG. 8, the second embodiment of an action load simulation mechanism 204 does not have a jack tail sensor 10. Instead, a wippen sensor 266 is provided for detecting the rotation of a wippen equivalent member 226. Since the other structure is the same as that of the first embodiment, the reference numerals of like components have the same last two digits as those in the first embodiment, and an explanation of the corresponding components is omitted herein.

Like the jack tail sensor 10, the wippen sensor 266 is formed of a rubber switch. When a player depresses a key 206, the wippen equivalent member 226 is influenced upward by a capstan equivalent member 220 and rotates counterclockwise as viewed in this figure. Upon key depression, the end of the wippen equivalent member 226 opposite to the end influenced by the capstan equivalent member 220 is lowered as shown by the dashed line in FIG. 8, thereby compressing the wippen sensor 266. The first sensor of the wippen sensor 266 turns on, and, subsequently, the second sensor of the wippen sensor 266 turns on. In the same manner as in the jack tail sensor 10, the turn ON timings of the first and second sensors are positioned in the flat key stroke region A2 shown in FIG. 7.

Therefore, except that a separate jack tail stopper felt equivalent member 230*b* is provided, the second embodiment of the action load simulation mechanism 204 provides the same effectiveness as the first embodiment. The wippen sensor 266, even when compressed, produces only little stress, and does not adversely affect the key touch.

Third Embodiment

Figure 10:
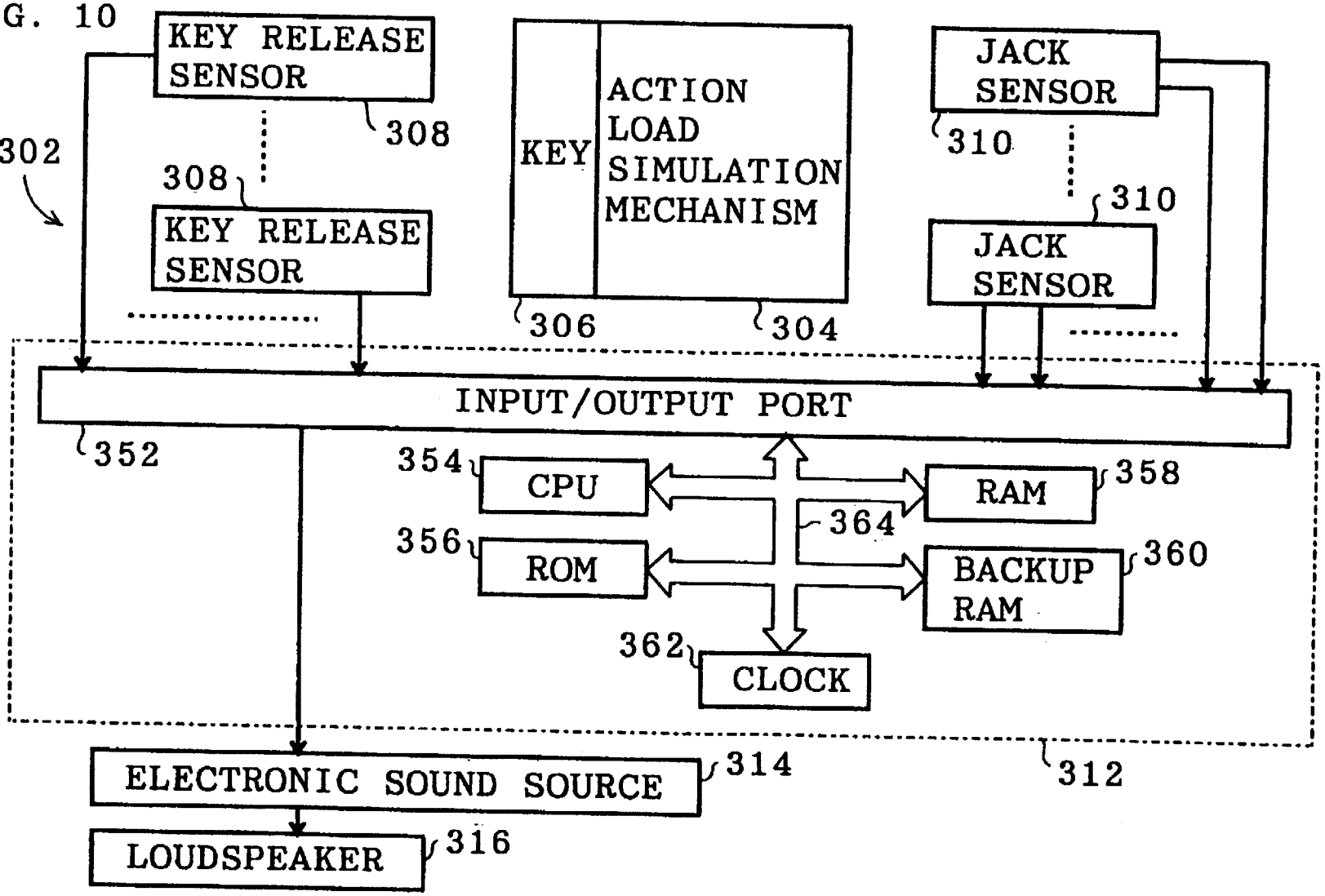
FIG. 10 is a block diagram showing an electronic upright piano according to a third embodiment of the present invention.

In the third embodiment of an electronic upright piano 302 shown in FIG. 10, jack sensors 310 are provided instead of the jack tail sensors 10 of the first embodiment. In the same manner as in the second embodiment, a jack tail stopper felt equivalent member 330*b* is provided on the underside of a regulating button equivalent member 330 for contacting a jack tail equivalent member 328*a*. Since the other structure is the same as that of the first embodiment, the reference numerals of like components have the same last two digits as those in the first embodiment, and an explanation of the corresponding components is omitted herein.

Figure 11:
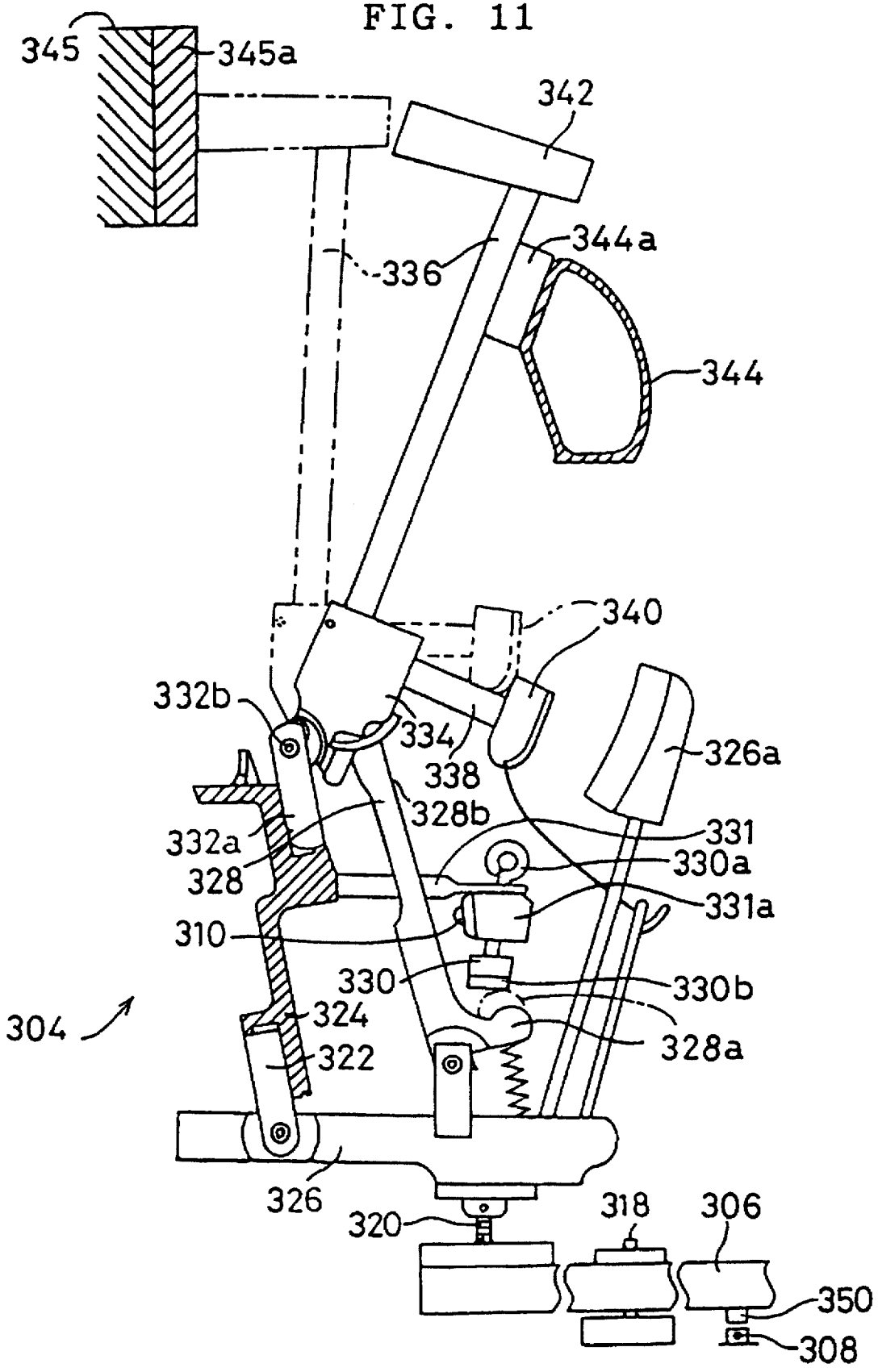
FIG. 11 is a sectional view of the third embodiment of an action load simulation load mechanism made in accordance with the present invention.

As shown in FIG. 11, the jack sensor 310 is provided on a surface of a regulating rail 331*a* which is supported by a regulating bracket 331 and is opposite to a side surface 328*b* of a jack equivalent member 328. The jack sensor 310 is formed of a rubber switch and also serves as the jack stopper felt equivalent member 31*c* of the first embodiment.

In operation of the electronic upright piano 302 having the aforementioned structure, after a player depresses a key 306, and the jack equivalent member 328 rises to a predetermined position, in the same manner as in the first embodiment, the jack tail equivalent member 328*a* contacts the jack tail stopper felt equivalent member 330*b* on the underside of the regulating button equivalent member 330, thereby causing the jack equivalent member 328 to rotate clockwise, as viewed in this figure, and disengage from or let off the butt equivalent member 334. The butt equivalent member 334, a hammer shank equivalent member 336 and a hammer equivalent member 342 disengage from the jack equivalent member 328, and inertially rotate. An adjacent side surface 328*b* of the jack equivalent member 328 contacts the jack sensor 310, and the hammer equivalent member 342 contacts the hammer stopper 345, thereby limiting the inertial rotation of the hammer equivalent member 342.

The third embodiment of the electronic upright piano 302 provides the following advantages, and the aforementioned advantages (2) to (5) of the first embodiment.

(1) The butt equivalent member 334 is connected via the hammer shank equivalent member 336 to the hammer equivalent member 342. The jack equivalent member 328 provides motive energy to the hammer equivalent member 342. The hammer equivalent member 342 contacts the hammer stopper 345 with motive energy which corresponds to a hammer striking a string in an acoustic piano. Therefore, the contact timing and strength of the jack tail equivalent member 328 on the jack sensor 310, immediately after the jack tail equivalent member 328 imparts motive energy to the hammer equivalent member 342, corresponds to the string striking timing and strength of the acoustic piano.

An adequate sound timing and sound intensity or volume are calculated by a controller 312 based on the contact timing and strength of the jack equivalent member 328 detected by the jack sensor 310. Therefore, upon key depression, a key touch response similar to that of an acoustic piano can be obtained.

Figure 12:
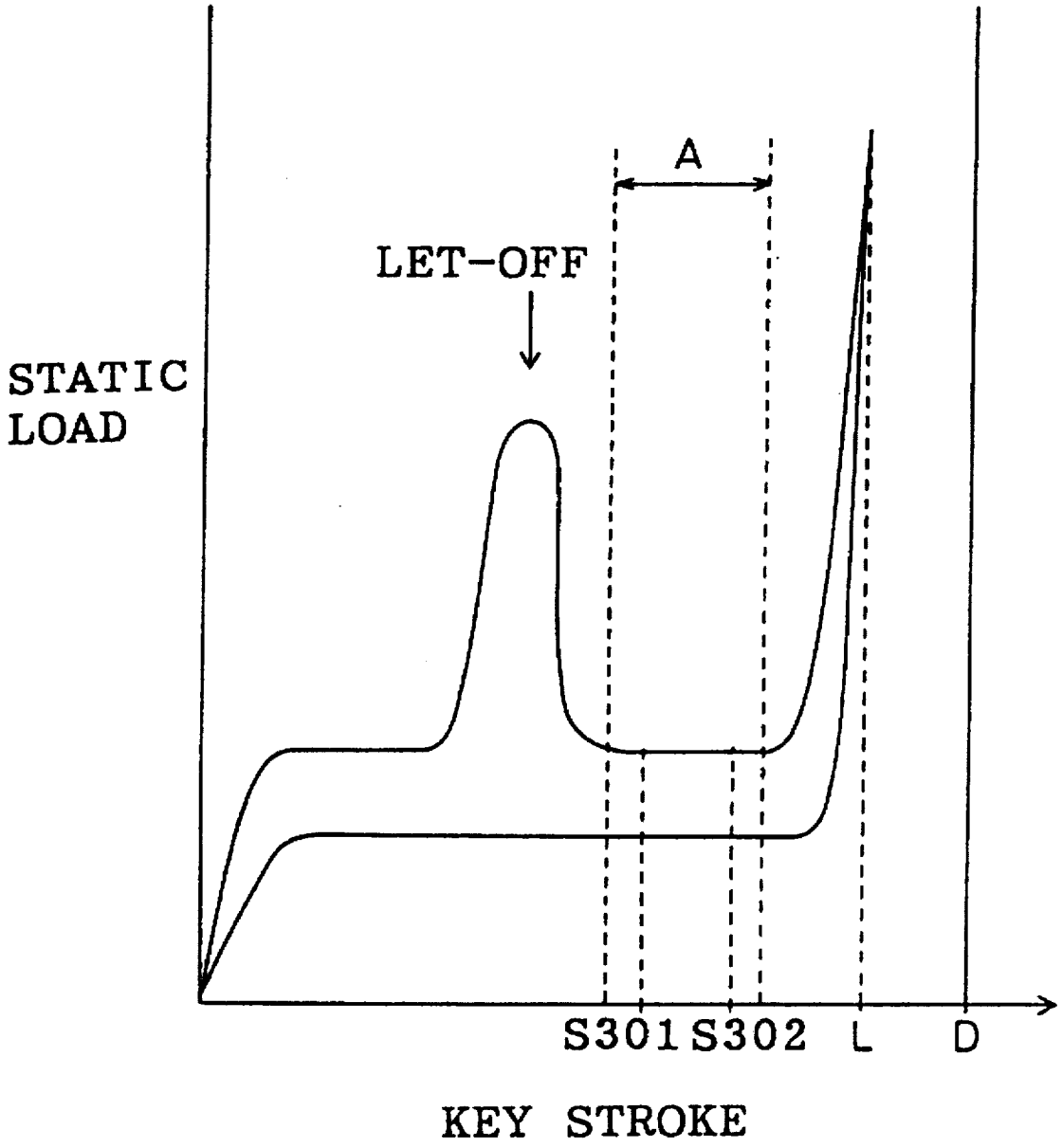
FIG. 12 is a graph showing the relationship of sensor detection positions of a key stroke and a static load of the third embodiment.

As shown in FIG. 12, the first and second sensors of jack tail sensor 310 detect the side surface 328*b* of the jack equivalent member 328 contacting the jack sensor 310 immediately after a substantial peak let-off resistance arises when the butt equivalent member 334, operatively connected to the hammer equivalent member 342, disengages from or lets off the jack equivalent member 328. Specifically, the jack sensor 310 detects the timing immediately before the jack equivalent member 328, disengaged from the butt equivalent member 334, is stopped. In the same manner as the jack tail sensor 10 shown in FIG. 6A, the jack sensor 310 is composed of a first sensor formed of the longer planar projection 11*b* and a second sensor of the shorter planar projection 11*c*. Also in the key stroke, as shown in FIG. 12, after the butt equivalent member 334 disengages from or lets off the hammer equivalent member 328, the first sensor turns on at a stroke position S301, and, subsequently, the second sensor turns on at a key stroke position S302.

As aforementioned, the detection of both the first and second sensors follows the substantially peak let-off resistance. Specifically, the detection position of the first or second sensor is not within the let-off resistance peak. Therefore, a time difference between the detection time of the first sensor and that of the second sensor can be stably and precisely obtained for each key, thereby correctly reflecting a player's key depression speed. The data corresponding to the string striking strength in an acoustic piano can be stably and precisely obtained for each key 306.

In the electronic upright piano 302, the sound intensity or volume can be stably and precisely controlled, while correctly reflecting the player's key operation. The key touch response is stabilized.

As shown in FIG. 12, the key stroke positions S301 and S302 occur after the let-off position and are sufficiently close to the key stroke limit L. Therefore, even a rather small key stroke amplitude, close to the key stroke limit, can be detected by the first and second sensors. When the same key is continuously depressed, sound can be continued without interruption.

As shown in FIG. 12, the let-off position occurs before and is sufficiently far from the key stroke limit L. Therefore, a sufficiently large region A with only a slight change in a static load can be obtained between the let-off position and the key stroke limit L, and thereby provide a sufficient distance between the detection positions of the first and second sensors for precise measurement.

The timing of the hammer equivalent member 342 contacts the hammer stopper 345 which corresponds to the string striking timing in the acoustic piano. As shown in FIG. 12, the contact timing occurs at a key stroke position D which is after the key stroke limit L. The detection position of the second sensor is close to the string striking equivalent key stroke position D. Therefore, the contact time of the hammer equivalent member 342 at the key stroke position D can be estimated with accuracy. The sound timing can also be stably and precisely controlled. Also in this respect the key touch response is stabilized.

Furthermore, the release time of the key 306 is detected by a key release sensor 308. The controller 312 can accurately obtain the sound stop time. The key stroke position of the key release time can occur before or after the let-off position, as long as the let-off resistance peak is avoided. When the key release time is detected at a position which is after the let-off position, the detection position of the key release timing is set before the detection position S302 of the second sensor.

As aforementioned, the contact timing and strength are detected by the jack sensor 310, while the key release timing is detected by the key release sensor 308. In the electronic upright piano 302, the sounding timing, the sound intensity or volume, the sound stop time, and the key touch response emulate those of an acoustic piano.

Fourth Embodiment

Figure 13:
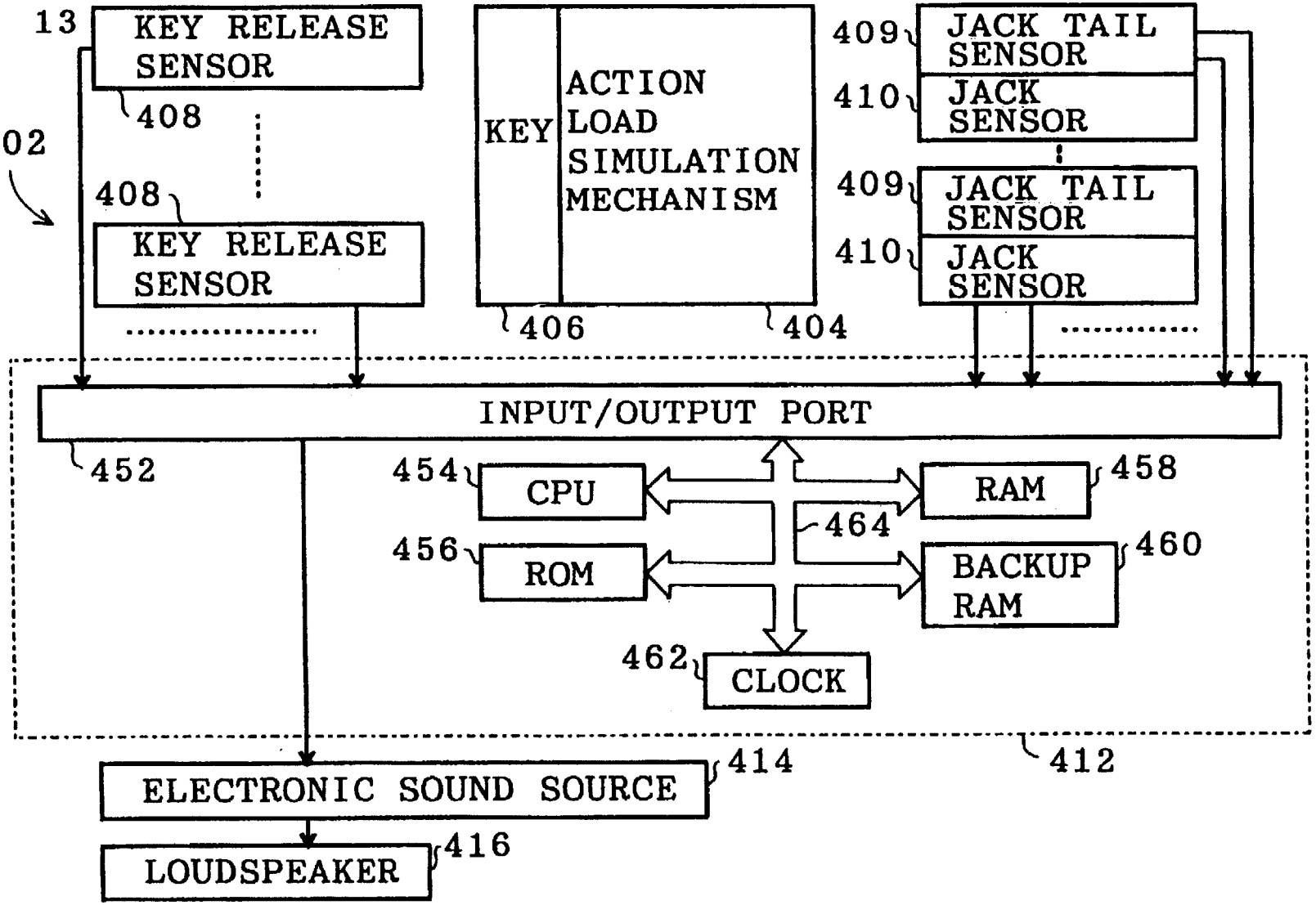
FIG. 13 is a block diagram showing an electronic upright piano according to a fourth embodiment of the present invention.

In the fourth embodiment of an electronic upright piano 402 shown in FIG. 13, jack sensors 410, as a second sensor, are provided in addition to jack tail sensors 409 as a first sensor. Since the other structure is the same as that of the first embodiment, the reference numerals of like components have the same last two digits as those in the first embodiment, and an explanation of the corresponding components is omitted herein.

Figure 14:
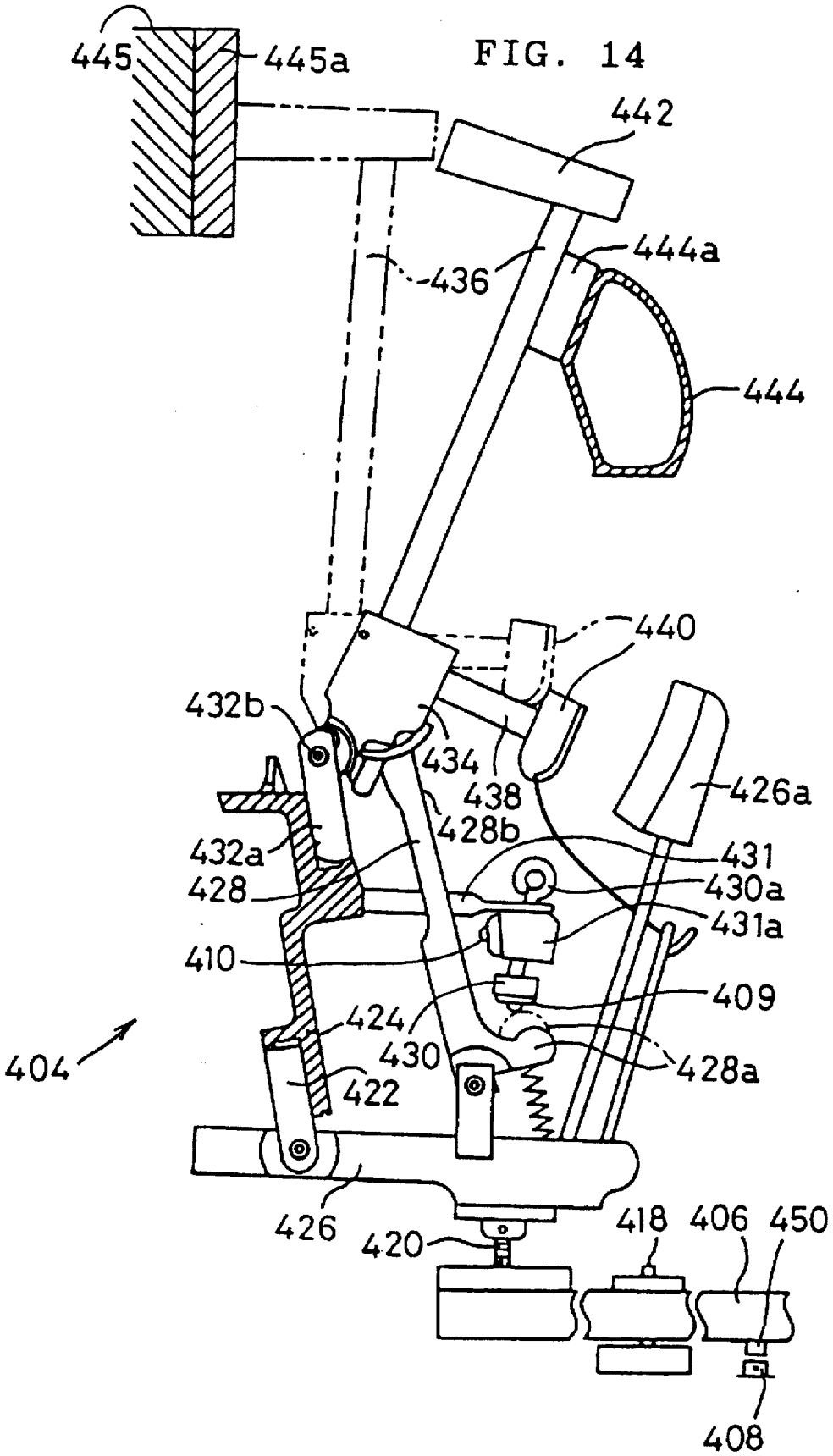
FIG. 14 is a sectional view of the fourth embodiment of an action load simulation mechanism made in accordance with the present invention.

As shown in FIG. 14, a jack sensor 410 is provided on the side surface of a regulating rail 431*a* supported by a regulating bracket 431 and is opposite to a side surface 428*b* of a jack equivalent member 428. The jack sensor 410 also serves as the jack stopper felt equivalent member 31*c* of the first embodiment.

In operation, the jack equivalent member 428 is raised, thrusting up the butt equivalent member 434 and causing a hammer equivalent member 442, fixed to the butt equivalent member 434, to rotate counterclockwise, as viewed in FIG. 14. When a jack tail equivalent member 428*a* of jack equivalent member 428 contacts the jack tail sensor 409 on the bottom of the regulating button equivalent member 430, the butt equivalent member 434 disengages from or lets off the jack equivalent member 428. Subsequently, the hammer equivalent member 442 inertially and continuously rotates counterclockwise, as viewed in FIG. 14, until the hammer equivalent member 442 contacts a hammer stopper felt 445*a* provided on a hammer stopper 445.

The jack sensor 410 corresponds to the jack stopper felt equivalent member 31*c* of the first embodiment, for contacting the side surface 428*b* of the jack equivalent member 428 having disengaged from the butt equivalent member 434.

As aforementioned, the jack tail sensor 409 contacts the jack tail equivalent member 428*a* before the let-off resistance applied on a key 406 by the hammer equivalent member 442 reaches its peak, thereby detecting the contact timing. The jack sensor 410 contacts the side surface 428*b* of the jack equivalent member 428 after the let-off resistance reaches its peak, thereby detecting the contact timing.

The jack tail sensor 409 and the jack sensor 410 are rubber hollow members and are easily deformed upon contact with the jack tail equivalent member 428*a* and the side surface 428*b*, respectively, such that inner conductive contacts connect inner terminals.

Figure 15A:
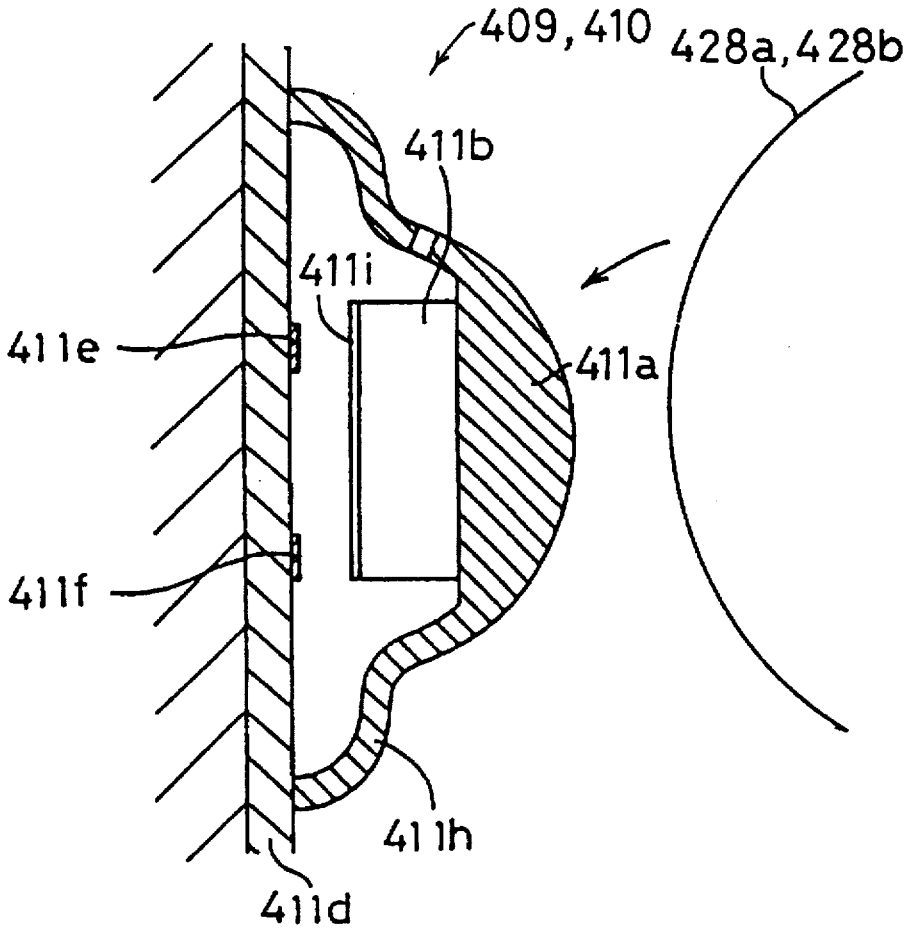
FIGS. 15A is a sectional view of a jack tail sensor and a jack sensor according to the fourth embodiment of the present invention.

As shown in FIG. 15A, in the jack tail sensor 409 and the jack sensor 410, a planar projection 411*b* projects inward from a rubber head 411*a*, and two terminals 411*e* and 411*f* are provided on a bottom plate 411*d*.

When the key 406 is depressed, causing the jack tail equivalent member 428*a* or the side surface 428*b* of the jack equivalent member 428 to compress a side wall 411*h* by a predetermined amount, a conductive contact 411*i* formed on an inwardly facing surface of the planar projection 411*b* completes a short circuit between the terminals 411*e* and 411*f*. Specifically, the jack tail sensor 409 and the jack sensor 410 are turned on.

Figure 15B:
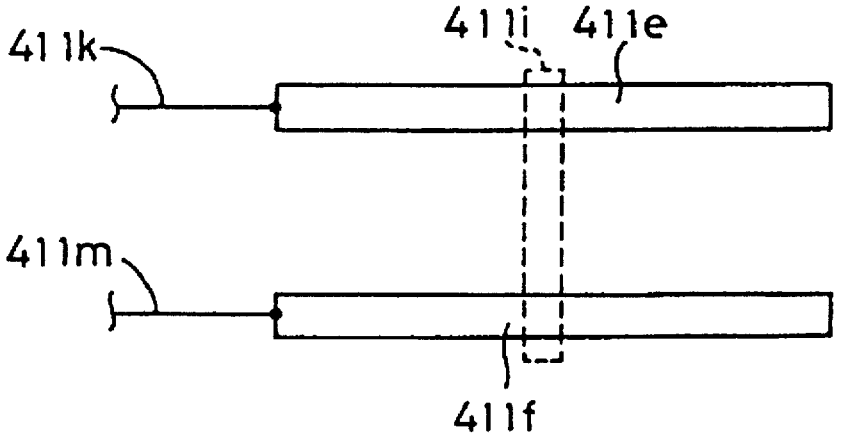
FIG. 15B is a diagrammatic view of terminals in the sensors.

Therefore, as shown in FIG. 15B, the contact timing of the jack tail equivalent member 428*a* or the side surface 428*b* of the jack equivalent member 428 is detected by the controller 412, by detecting a change in impedance between signal lines 411*k* and 411*m*. The controller 412 can also detect the contact intensity or speed by detecting a time difference between the detection times of the jack tail sensor 409 and the jack sensor 410.

In operation of the electronic upright piano 402 having the aforementioned structure, after a player depresses the key 406, and the jack equivalent member 428 rises to a predetermined position, in the same manner as in the first embodiment, the jack tail equivalent member 428*a* contacts the jack tail sensor 409 on the underside of the regulating button equivalent member 430, thereby causing the jack equivalent member 428 to rotate clockwise, as viewed in this figure, and disengage from or let off the butt equivalent member 434. The butt equivalent member 434, a hammer shank equivalent member 436 and the hammer equivalent member 442, disengaged from the jack equivalent member 428, and inertially rotate. The side surface 428*b* of the jack equivalent member 428 then contacts the jack sensor 410, and the hammer equivalent member 442 contacts the hammer stopper 445, thereby limiting the inertial rotation of the hammer equivalent member 442.

The fourth embodiment of the electronic upright piano 402 provides the following advantages, and the aforementioned advantages (2) to (5) of the first embodiment.

(1) The butt equivalent member 434 is connected via the hammer shank equivalent member 436 to the hammer equivalent member 442. The jack equivalent member 428 provides motive energy to the hammer equivalent member 442. The hammer equivalent member 442 contacts the hammer stopper 445 with motive energy which corresponds to a hammer striking a string in an acoustic piano. Therefore, the contact timing and strength of the jack tail equivalent member 428 on the jack tail sensor 409, before the jack tail equivalent member 428 imparts motive energy to the hammer equivalent member 442, and that of the side surface 428*b* of the jack equivalent member 428 on the jack sensor 410, after the jack tail equivalent member 428 completely imparts motive energy to the hammer equivalent hammer, reflect the string striking timing and strength of the acoustic piano.

An adequate sound timing and sound intensity or volume are calculated by a controller 412, based upon the sound intensity or volume detected from a time difference between the detected times of the jack tail sensor 409 and that of the jack sensor 410, and the contact time of the jack equivalent member 428 detected by the jack sensor 410, detected by the jack sensor 410, for controlling the sound timing. Therefore, upon key depression, a key touch response similar to that of an acoustic piano can be obtained.

Figure 16:
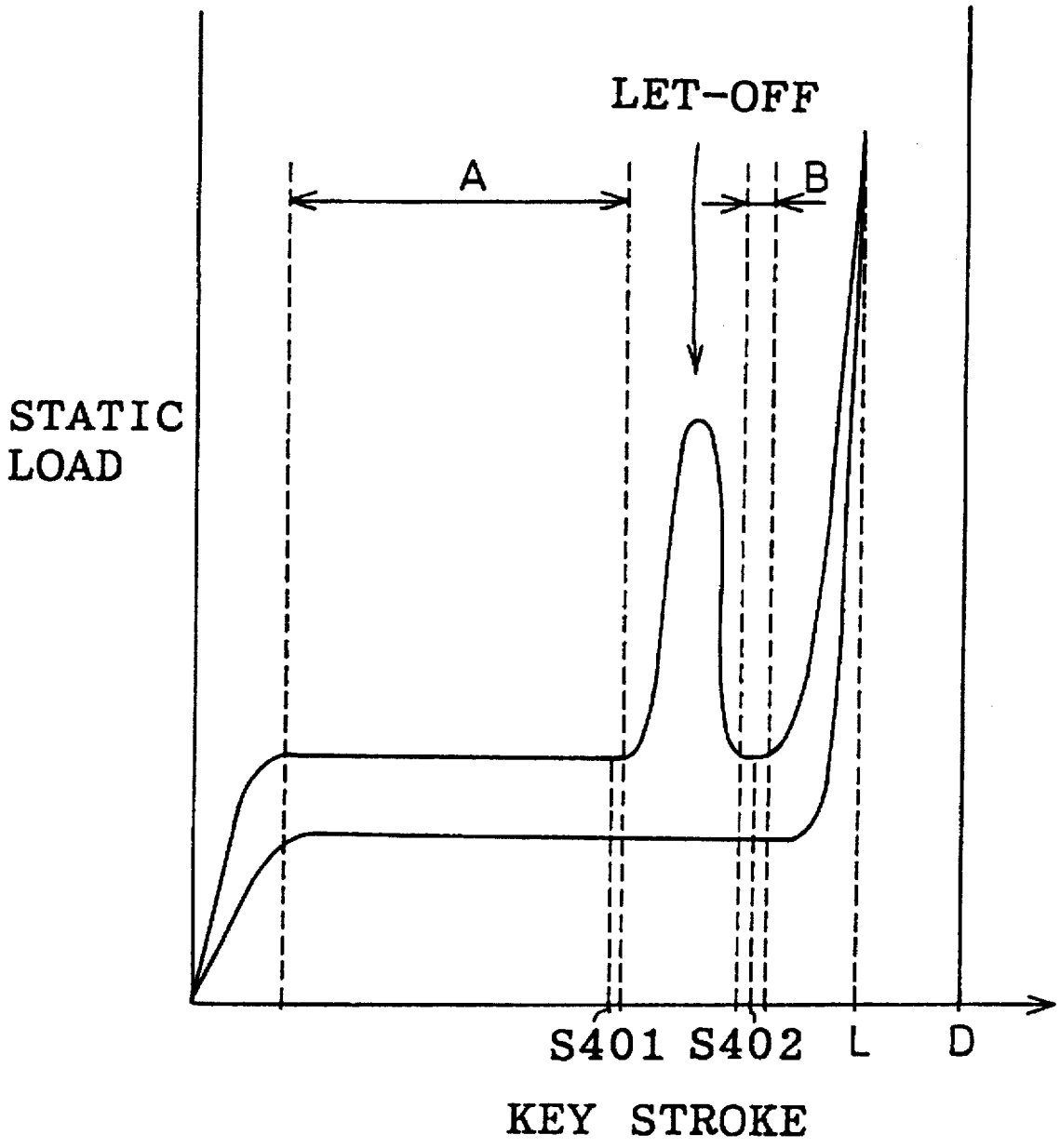
FIG. 16 is a graph showing the relationship of sensor detection positions of a key stroke and a static load of the fourth embodiment.

As shown in FIG. 16, the jack tail sensor 409 detects the time when the jack tail equivalent member 428*a* contacts the jack tail sensor 409 at a first predetermined position S401 in a flat region A with only a slight change in the static load, before a substantially peak let-off resistance arises when the butt equivalent member 434, operatively connected to the hammer equivalent member 442, disengages from or lets off the jack equivalent member 428. The jack sensor 410 detects the time when the side surface 428*b* of the jack equivalent member 428 contacts the jack sensor 410 at a second predetermined position S402 in a flat region B with only a slight change in the static load, after a substantially peak let-off resistance arises when the butt equivalent member 434, operatively connected to the hammer equivalent member 442, disengages from or lets off the jack equivalent member 428.

As aforementioned, the detection position of the jack tail sensor 409 or the jack sensor 410 is not located within the let-off resistance peak.

Therefore, a time difference between the detection time of the jack tail sensor 409 and that of the jack sensor 410 can be stably and precisely obtained for each key, correctly reflecting a player's key depression speed. The data corresponding to the string striking strength of an acoustic piano can be stably and precisely obtained for each key 406.

In the electronic upright piano 402, the sound intensity or volume can be stably and precisely controlled, while correctly reflecting the player's key operation. The key touch response is stabilized.

As shown in FIG. 16, the key stroke positions S402 is after the let-off position, sufficiently close to the key stroke limit L, and is disposed closer to a key stroke position D which corresponds to a string striking position in an acoustic piano. Therefore, a string striking equivalent time can be estimated from the detected time of the jack sensor 410 with a minor error.

Only the first predetermined detection position S401 is set in a region A, before the key stroke let-off resistance peak position. Accordingly, the detection position of the jack tail sensor 409 can be sufficiently closer to the let-off resistance peak position. Even a rather small key stroke amplitude, at a deep key stroke position, can be detected by the jack tail sensor 409 and the jack sensor 410. The sound resulting from a continuous depression of the same key can be continued without interruption.

As shown in FIG. 16, only the second predetermined detection position S402 exists in region B further along the key stroke, and the let-off position can occur prior thereto. Therefore, the key touch similar to that of an acoustic piano can be provided.

Furthermore, the release timing of the key 406 is detected by a key release sensor 408. The controller 412 can surely obtain the sound stop time. The key stroke position of the key release time can be before or after the let-off position, as long as the let-off resistance peak is avoided. When the key release time is detected at the position after the let-off position, the detection position of the key release time is set before the detection position S402 of the second sensor.

As aforementioned, the contact timing of the jack tail equivalent member 428*a* is detected by the jack tail sensor 409, the contact timing of the side surface 428*b* of the jack equivalent member 428 is detected by the jack sensor 410, and the key release time is detected by the key release sensor 408. In the electronic upright piano 402, the sound timing, the sound intensity or volume, the sound stop timing, and the key touch response can be equal to those of an acoustic piano.

MODIFICATIONS

This invention has been described above with reference to the preferred embodiments as shown in the figures. Modifications and alterations may become apparent to one skilled in the art upon reading and understanding the specification. Despite the use of the embodiments for illustration purposes, the invention is intended to include all such modifications and alterations within the spirit and scope of the appended claims.

In this spirit, the key release sensors 8, 208, 308 and 408 are composed of a photo sensor, but can be formed of a rubber switch like the jack tail sensor 409 and the jack sensor 410. In the rubber switch, a conductive contact of a planar projection makes a short circuit across a pair of terminals.

In the embodiments, the jack tail sensors 10 and 409, the wippen sensor 266 and the jack sensors 310 and 410 are formed of a rubber switch, but can be formed of a photo sensor like the key release sensors 8, 208, 308, 408. In this case, the jack tail equivalent member 28*a*, 428*a*, the wippen equivalent member 226, the side face 328*b*, 428*b* of the jack equivalent member 328, 428 are provided with a stepped shutter. The key stroke position S1, S2, S201, S202, S301, S302, S401 or S402 is detected by detecting the time at which a light path of a photo-interrupter provided in the jack tail sensor 10, the wippen sensor 266, the jack sensor 310, and the jack tail sensor 409 or the jack sensor 410, is interrupted by the stepped shutter.

Figure 9:
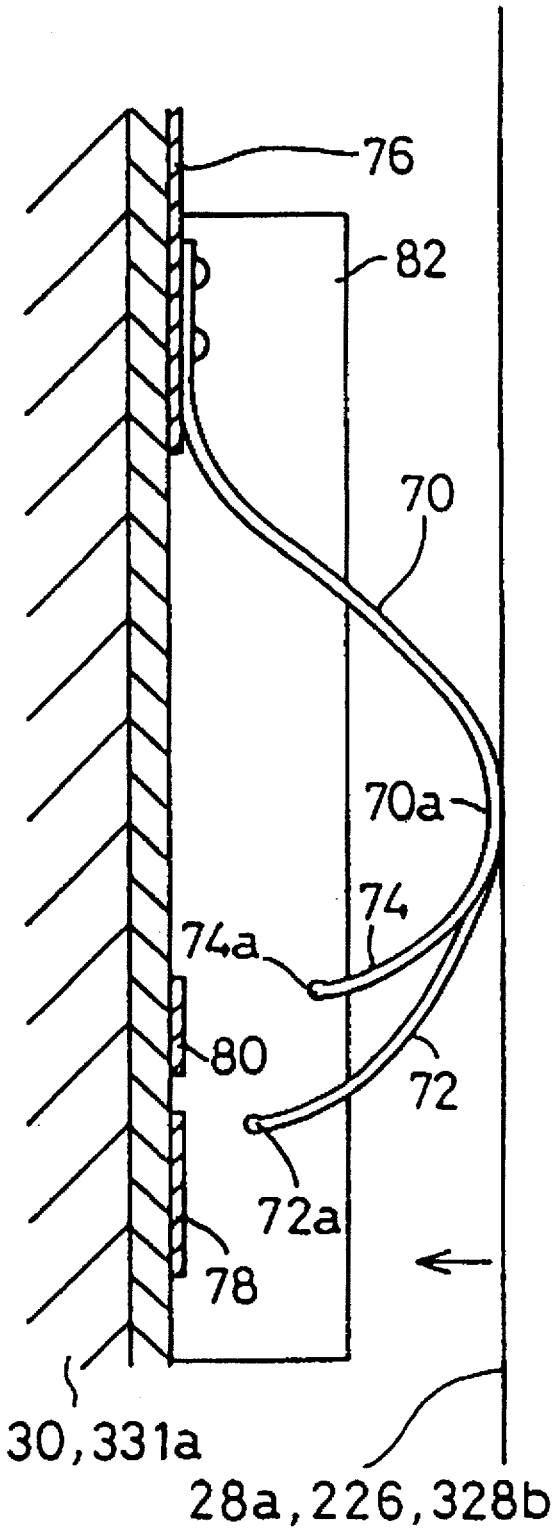
FIG. 9 is a sectional view of a leaf switch to replace a rubber switch of the jack tail sensor.

The jack tail sensor 10, the wippen sensor 266, the jack sensor 310 can be replaced, for example, with a leaf switch of a metal spring 70 provided on the regulating button equivalent member 30 or the regulating rail member 331*a*, as shown in FIG. 9. The spring 70 has two arms 72 and 74 on one end, and the other end is electrically connected to a terminal 76. When an intermediate portion 70*a* of the spring 70 is depressed by the jack tail equivalent member 28*a*, the wippen equivalent member 226, or the side surface 328*b* of jack equivalent member 328, the spring 70 is deformed by a predetermined amount, thereby causing a tip 72*a* of the longer arm 72 to contact a terminal 78. When the spring 70 is further deformed by a predetermined amount, a tip 74*a* of the other arm 74 contacts a terminal 80.

In FIG. 9, a first short circuit is made between the terminals 76 and 78 and, subsequently, a short circuit is made between the terminals 76 and 80. In the same manner as in the jack tail sensor 10, the wippen sensor 266 and the jack sensor 310, as shown in FIG. 6, the timing of the component reaching the key stroke positions S1, S2, S301, S302 can be detected. A cushioning material 82, formed of rubber, is disposed on both sides of or around the spring 70, to prevent the jack tail equivalent member 28*a*, the wippen equivalent member 226 or the side surface 328*b* of jack equivalent member 328 from completely compressing or damaging the spring 70. The jack tail equivalent member 28*a*, the wippen equivalent member 226 or the side surface 328*b* of the jack equivalent member 328 contacts the cushioning material 82, before permanently deforming the spring 70.

Figure 17:
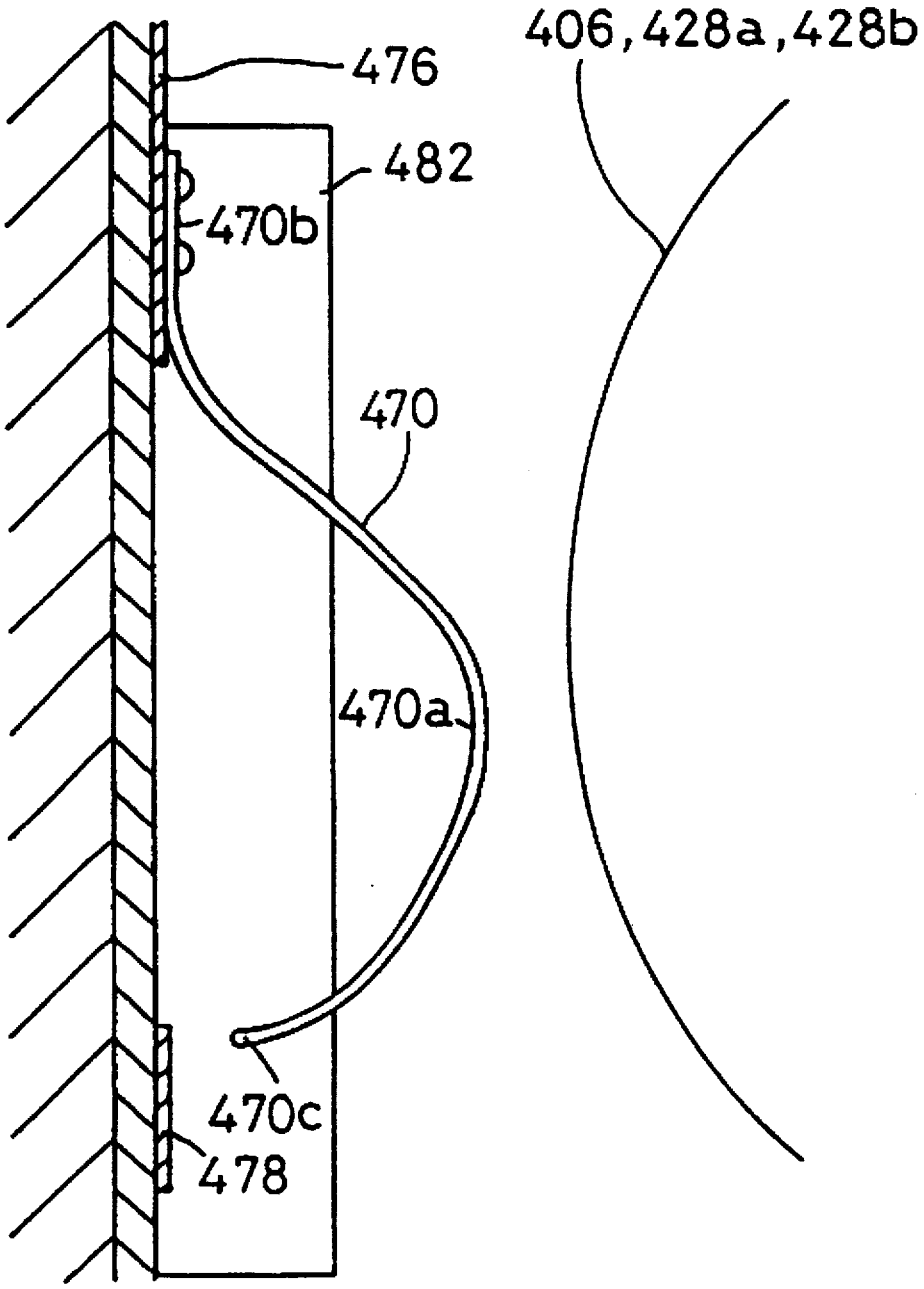
FIG. 17 is a sectional view of a leaf switch to replace a rubber switch of the jack tail sensor or the jack sensor.
Figure 18:
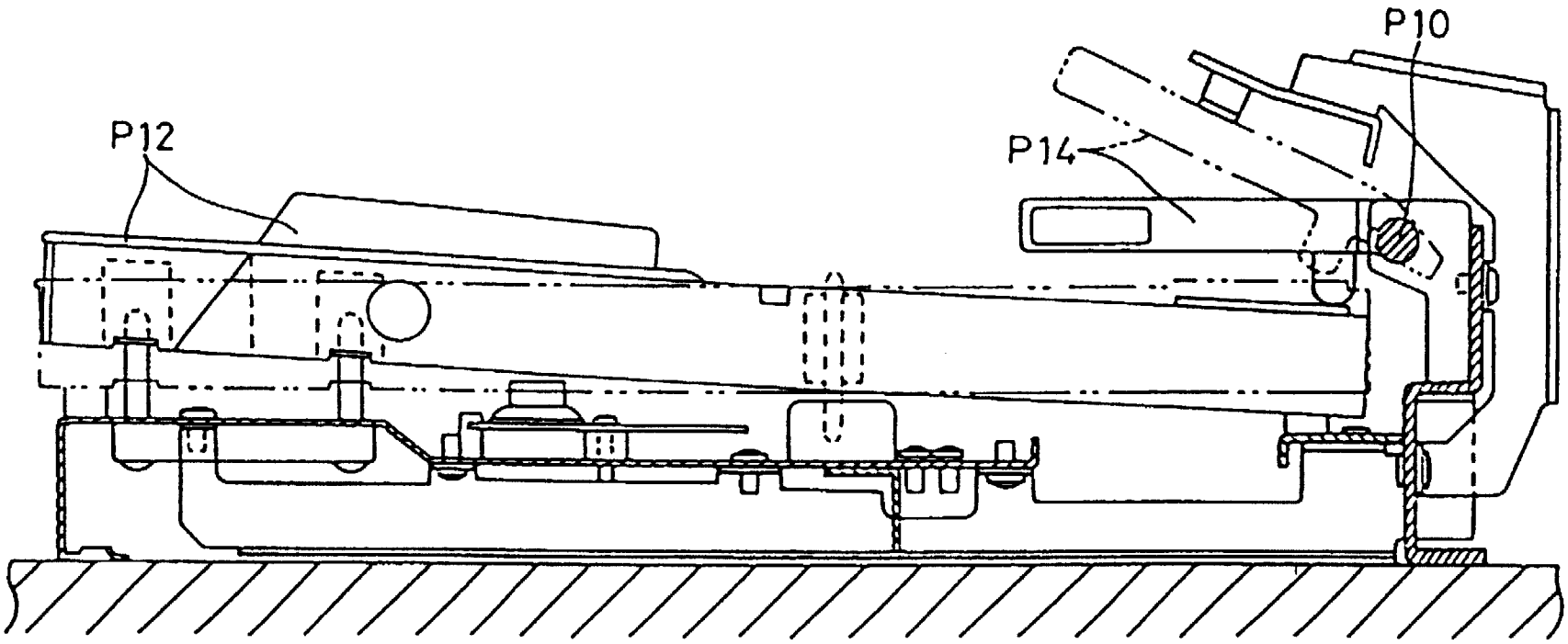
FIG. 18 PRIOR ART
FIG. 18 is a sectional diagrammatic view of a conventional keyboard.
Figure 19:
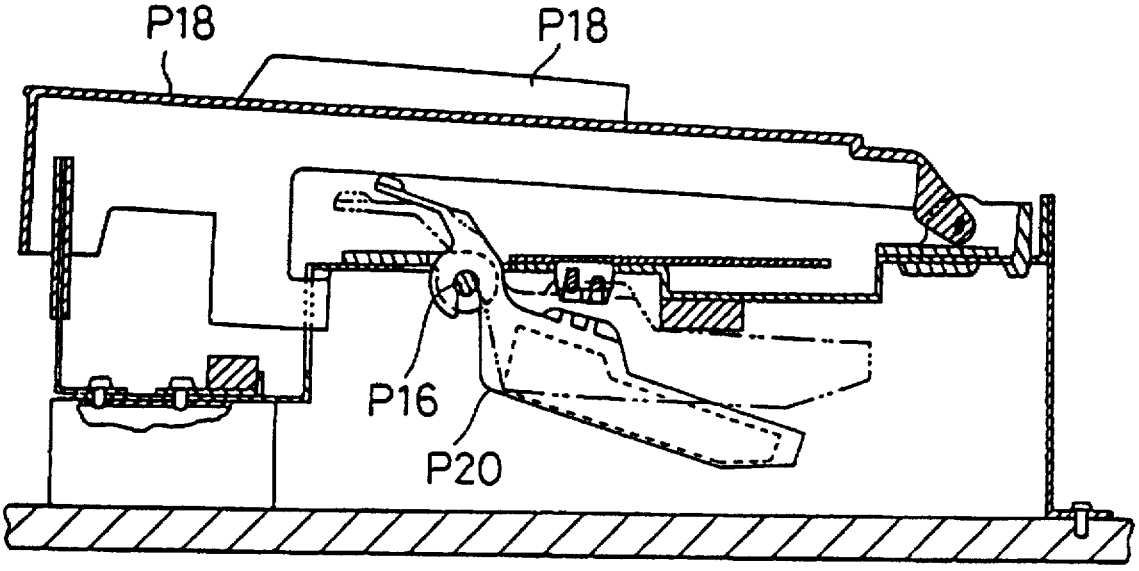
FIG. 19 PRIOR ART
FIG. 19 is a sectional diagrammatic view of a conventional keyboard.

In the fourth embodiment, the key release sensor 408, the jack tail sensor 409 or the jack sensor 410 can be replaced, for example, with a leaf switch of a metal spring 470 as shown in FIG. 17. The spring 470 is curved and an intermediate portion 470*a* is projected. An end 470*b* of the spring 470 is electrically connected to a terminal 476, and a tip 470*c* of the spring 470 is located opposite to a terminal 478. When the intermediate portion 470*a* of the spring 470 is depressed by the key 406, the jack tail equivalent member 428*a* or the side surface 428*b* of the jack equivalent member 428, the spring 470 is deformed by a predetermined amount, thereby causing the tip 470*c* of the spring 470 to contact the terminal 478.

In FIG. 17, a short circuit is made between the terminals 476 and 478. In the same manner as in the rubber switch shown in FIG. 15A, the contact timing can be detected. A cushioning material 482, formed of rubber, is disposed on both sides of or around the spring 470, for preventing the key 406, the jack tail equivalent member 428*a* or the side surface 428*b* of the jack equivalent member 428 from completely compressing or damaging the spring 470. The key 406, the jack tail equivalent member 428*a* or the side face 428*b* of the jack equivalent member 428 contacts the cushioning material 482, before permanently deforming the spring 470.

The key release sensor 8, 208, 308, 408, the jack tail sensor 10, the wippen sensor 266, the jack sensor 310, the jack tail sensor 409 or the jack sensor 410 can also be formed of a pressure sensor.

The embodiments relate to the electronic upright piano, but can also be applied to an electronic grand piano.

In the embodiments the release of the key 6, 206, 306, 406 is directly detected. The release of an associated member of the key 6, 206, 306, 406, if any, can be detected such that the key release timing is obtained.

Further, in the first, second and third embodiments, by detecting the time at which the first sensor or the second sensor of the jack tail sensor 10, the wippen sensor 266 or the jack sensor 310 is changed from ON to OFF, the key release time can be key detected without the release sensor 8, 208 or 308. The jack tail sensor 10, the wippen sensor 266 and the jack sensor 310 can thus serve as the key release sensors 8, 208 and 308, respectively.

Also in the fourth embodiment, by detecting the time at which the jack tail sensor 409 is changed from ON to OFF, the key release time can be detected without the key release sensor 408. The jack tail sensor 409 or the jack sensor 410 can thus serve as the key release sensor 408.

The movement of the jack tail equivalent member 28*a* is directly detected by the jack tail sensor 10. However, the movement of a member other than the jack tail equivalent member 28*a*, or an associated member of the jack equivalent member 28, can be detected, for indirectly detecting the movement of the jack equivalent member 28.

The movement of the wippen equivalent member 226 is directly detected by the wippen sensor 266. However, the movement of a catcher equivalent member 226*a* or other associated member of the wippen equivalent member 226 can be detected, for indirectly detecting movement of the wippen equivalent member 226.

In the third embodiment, the movement of the jack equivalent member 328 is directly detected by the jack sensor 310. However, the movement of any associated member of the jack equivalent member 328 can be detected, for indirectly detecting movement of the jack equivalent member 328.

In the fourth embodiment, any position of the jack equivalent member 428 can be detected, for detecting the time of the second specified position S402 or the first predetermined position S401 in the jack tail sensor 409 or the jack sensor 410.

What is claimed is:

1. A keyboard for an electronic instrument for applying an action simulating load to a key, comprising:

a plurality of keys being supported by said keyboard; and an action load simulation mechanism associated with each of said plurality of keys, comprising:

a wippen equivalent member being operable coupled for rotating together with an associated key during key depression;

a jack equivalent member being operable coupled to said wippen equivalent member for moving as said wippen equivalent member is rotated during the key depression;

a hammer equivalent member for being pushed and rotated by said jack equivalent member while said jack equivalent member moves to a predetermined position and for disengaging from said jack equivalent member and continuing to inertially rotate after said jack equivalent member moves to the predetermined position; and a stop for engaging with said hammer equivalent member and stopping inertial movement of said hammer equivalent member;

a first sensor for detecting a first time at which a member of said action load simulation mechanism reaches a first predetermined position, said first time being close to a time where a substantially peak resistance is applied by said hammer equivalent member after disengagement from said jack equivalent member; and a second sensor for detecting a second time at which a member of said action load simulation mechanism reaches a second predetermined position, said second time being close to a time where the substantially peak resistance is applied to said hammer equivalent member after disengagement from said jack equivalent member; and said first sensor detects said first time before said second sensor detects said second time.

2. A keyboard for an electronic instrument according to claim 1, wherein said first sensor detects said first time before the substantially peak resistance is applied to said hammer equivalent member and said second sensor detects said second time before the substantially peak resistance is applied to said hammer equivalent member.

3. A keyboard for an electronic instrument according to claim 2, wherein said member of said action load simulation mechanism to be detected by said first sensor comprises one of said key, said wippen equivalent member, said jack equivalent member, an associated member thereof, and a jack tail equivalent member provided on said jack equivalent member.

4. A keyboard for an electronic instrument according to claim 2, wherein said member of said action load simulation mechanism to be detected by said second sensor comprises one of said key, said wippen equivalent member, said jack equivalent member, an associated member thereof, and a jack tail equivalent member provided on said jack equivalent member.

5. A keyboard for an electronic instrument according to claim 2, further comprising a third sensor for detecting a key release time, and said third sensor detects said key release time of one of said key, said wippen equivalent member, said jack equivalent member and an associated member thereof.

6. A keyboard for an electronic instrument according to claim 2, wherein said second sensor also detects a key release time of one of said key, said wippen equivalent member, said jack equivalent member and an associated member thereof for stopping sound.

7. A keyboard for an electronic instrument according to claim 5 with said keyboard being incorporated into an electronic piano, and said electronic piano further comprising an electronic sound control means for controlling a sound timing based on said first time detected by said first sensor, controlling a sound intensity based on a time difference between said first time and the second time, and controlling a sounding stop time based on a key release time detected by said third sensor.

8. A keyboard for an electronic instrument according to claim 1, wherein said first sensor detects said first time after the substantially peak resistance is applied to said hammer equivalent member and said second sensor detects said second time after the substantially peak resistance is applied to said hammer equivalent member.

9. A keyboard for an electronic instrument according to claim 8, wherein said member of said action load simulation mechanism to be detected by said first sensor comprises one of said key, said wippen equivalent member, said jack equivalent member and an associated member thereof, and said member of said action load simulation mechanism to be detected by said second sensor comprises one of said key, said wippen equivalent member, said jack equivalent member and an associated member thereof.

10. A keyboard for an electronic instrument according to claim 8, wherein a region in which a resistance applied by said hammer equivalent member to a key, upon disengagement from said jack equivalent member, is substantially constant and is provided after the resistance reaches its substantial peak, and said region is located between said first predetermined position and said second predetermined position.

11. A keyboard for an electronic instrument according to claim 8, further comprising a third sensor for detecting a key release time, and said third sensor detects the key release time of one of said key, said wippen equivalent member, said jack equivalent member and an associated member thereof.

12. A keyboard for an electronic instrument according to claim 8, wherein said second sensor also detects a key release time of one of said key, said wippen equivalent member, said jack equivalent member and an associated member thereof for stopping sound.

13. A keyboard for an electronic instrument according to claim 11 with said keyboard being incorporated into an electronic piano, said electronic piano further comprising an electronic sound control means for controlling a sound timing based on said first time detected by said first sensor, controlling a sound intensity based on a time difference between said first time and said second time, and controlling a sound stop time based on a key release time detected by said third sensor.

14. A keyboard for an electronic instrument according to claim 1, wherein said first sensor detects said first time before the substantially peak resistance is applied to said hammer equivalent member and said second sensor detects said second time after the substantially peak resistance is applied by said hammer equivalent member.

15. A keyboard for an electronic instrument according to claim 14, wherein said member of said action load simulation mechanism to be detected by said first sensor comprises one of said key, said wippen equivalent member, said jack equivalent member and an associated member thereof.

16. A keyboard for an electronic instrument according to claim 14, wherein said member of said action load simulation mechanism to be detected by said second sensor comprises one of said key, said wippen equivalent member, said jack equivalent member and an associated member thereof.

17. A keyboard for an electronic instrument according to claim 14, further comprising a third sensor for detecting a key release time, and said third sensor detects said key release time of one of said key, said wippen equivalent member, said jack equivalent member and an associated member thereof.

18. A keyboard for an electronic instrument according to claim 14, wherein said second sensor also detects a key release time of one of said key, said wippen equivalent member, said jack equivalent member and an associated member thereof for stopping sound.

19. A keyboard for an electronic instrument according to claim 14, wherein a first region in which a resistance applied by said hammer equivalent member to a key, upon disengagement from said jack equivalent member, is substantially constant and is provided before the resistance reaches its substantial peak, a second region in which the resistance is substantially constant is provided after the resistance reaches its substantial peak, said first predetermined position occurring within said first region, and said second predetermined position occurring within said second region.

20. A keyboard for an electronic instrument according to claim 17 with said keyboard being incorporated into an electronic piano, and said electronic piano further comprising an electronic sound control means for controlling a sound timing based on said first time detected by said first sensor, controlling a sound intensity based on a time difference between said first time and said second time, and controlling a sound stop time based on a key release time detected by said third sensor.

* * * * *